US007100687B2

(12) United States Patent
Pauley

(10) Patent No.: US 7,100,687 B2
(45) Date of Patent: Sep. 5, 2006

(54) MULTI-PURPOSE WELL BORES AND METHOD FOR ACCESSING A SUBTERRANEAN ZONE FROM THE SURFACE

(75) Inventor: Steven R. Pauley, Bluefield, WV (US)

(73) Assignee: CDX Gas, LLC, Dallas, TX (US)

( * ) Notice: Subject to any disclaimer, the term of this patent is extended or adjusted under 35 U.S.C. 154(b) by 240 days.

(21) Appl. No.: 10/715,300

(22) Filed: Nov. 17, 2003

(65) Prior Publication Data

US 2005/0103490 A1 May 19, 2005

(51) Int. Cl.
*E21B 43/30* (2006.01)

(52) U.S. Cl. ..... 166/245; 166/313; 166/50

(58) Field of Classification Search ..... 166/245, 166/313, 50
See application file for complete search history.

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |

(Continued)

FOREIGN PATENT DOCUMENTS

| | | | |
|---|---|---|---|
| AU | 85/49964 | A | 11/1986 |

(Continued)

OTHER PUBLICATIONS

Notification of Transmittal of the International Search Report or the Declaration (PCT Rule 44.1) mailed Feb. 9, 2004 (6 pages) re International Application No. PCT/US 03/28138, Sep. 9, 2003.

(Continued)

*Primary Examiner*—David Bagnell
*Assistant Examiner*—Shane Bomar
(74) *Attorney, Agent, or Firm*—Fish & Richardson P.C.

(57) ABSTRACT

A well system includes at least two well bores extending from a surface to a subterranean zone. Each of the two well bores is used to form a well bore pattern for the subterranean zone that intersects the other well bore and transports fluid from the subterranean zone to the other well bore for production to the surface. In addition, each of the two well bores is operable to collect fluids transported to the well bore by the well bore pattern formed through the other well bore for production to the surface.

22 Claims, 8 Drawing Sheets

U.S. PATENT DOCUMENTS

| | | | | |
|---|---|---|---|---|
| 2,847,189 | A | 8/1958 | Shook | 255/76 |
| 2,911,008 | A | 11/1959 | Du Bois | 137/625.31 |
| 2,934,904 | A | 5/1960 | Hendrix | |
| 2,980,142 | A | 4/1961 | Turak | 137/637.3 |
| 3,163,211 | A | 12/1964 | Henley | |
| 3,208,537 | A | 9/1965 | Scarborough | 175/53 |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,534,822 | A | 10/1970 | Campbell et al. | |
| 3,578,077 | A | 5/1971 | Glenn, Jr. et al. | |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,763,652 | A | 10/1973 | Rinta | |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Anderson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,136,996 | A | 1/1979 | Burns | |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A | 1/1980 | Ziebarth et al. | |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | 166/250 |
| 4,226,475 | A | 10/1980 | Frosch et al. | |
| 4,257,650 | A | 3/1981 | Allen | 299/2 |
| 4,278,137 | A | 7/1981 | Van Eek | |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | 299/7 |
| 4,442,896 | A | 4/1984 | Reale et al. | 166/278 |
| 4,463,988 | A | 8/1984 | Bouck et al. | |
| 4,494,616 | A | 1/1985 | McKee | 175/67 |
| 4,502,733 | A | 3/1985 | Grubb | |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,662,440 | A * | 5/1987 | Harmon et al. | 166/245 |
| 4,674,579 | A | 6/1987 | Geller et al. | 175/45 |
| 4,676,313 | A | 6/1987 | Rinaldi | |
| 4,702,314 | A | 10/1987 | Huang et al. | 166/245 |
| 4,705,109 | A | 11/1987 | Ledent et al. | |
| 4,705,431 | A | 11/1987 | Gadelle et al. | 405/267 |
| 4,715,440 | A | 12/1987 | Boxell et al. | 166/100 |
| 4,718,485 | A | 1/1988 | Brown et al. | |
| 4,727,937 | A | 3/1988 | Shum et al. | |
| 4,753,485 | A | 6/1988 | Goodhart | |
| 4,754,808 | A * | 7/1988 | Harmon et al. | 166/245 |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,889,186 | A | 12/1989 | Hanson et al. | |
| 4,978,172 | A | 12/1990 | Schwoebel et al. | 299/12 |
| 5,016,709 | A | 5/1991 | Combe et al. | |
| 5,016,710 | A | 5/1991 | Renard et al. | 166/245 |
| 5,033,550 | A | 7/1991 | Johnson et al. | |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,115,872 | A | 5/1992 | Brunet et al. | |
| 5,127,457 | A | 7/1992 | Stewart et al. | |
| 5,135,058 | A | 8/1992 | Millgard et al. | 175/71 |
| 5,148,875 | A | 9/1992 | Karlsson et al. | 175/62 |
| 5,148,877 | A | 9/1992 | MacGregor | |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |

5,193,620 A 3/1993 Braddick ..... 166/382
5,194,859 A 3/1993 Warren ..... 340/853.4
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,289,888 A 3/1994 Talley
5,301,760 A 4/1994 Graham ..... 175/61
5,343,965 A 9/1994 Talley et al.
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al. ..... 166/105.5
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Anderson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,853,054 A 12/1998 McGarian et al. ..... 175/267
5,853,056 A 12/1998 Landers ..... 175/424
5,853,224 A 12/1998 Riese ..... 299/13
5,863,283 A 1/1999 Gardes ..... 588/250
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,917,325 A 6/1999 Smith ..... 324/326
5,934,390 A 8/1999 Uthe ..... 175/67
5,938,004 A 8/1999 Roberts et al. ..... 198/812
5,941,307 A 8/1999 Tubel
5,941,308 A 8/1999 Malone et al. ..... 166/313
5,944,107 A 8/1999 Ohmer
5,957,539 A 9/1999 Durup et al. ..... 299/4
5,971,074 A 10/1999 Longbottom et al. ..... 166/313
5,988,278 A 11/1999 Johnson
5,992,524 A 11/1999 Graham
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A 5/2000 Gano et al.
6,065,550 A 5/2000 Gardes ..... 175/62
6,065,551 A 5/2000 Gourley et al.
6,079,495 A 6/2000 Ohmer
6,089,322 A 7/2000 Kelley et al.
6,119,771 A 9/2000 Gano et al. ..... 166/50
6,119,776 A 9/2000 Graham et al.
6,135,208 A 10/2000 Gano et al. ..... 166/313
6,170,571 B1 1/2001 Ohmer
6,179,054 B1 1/2001 Stewart ..... 166/105.5
6,189,616 B1 2/2001 Gano et al.
6,192,988 B1 2/2001 Tubel
6,199,633 B1 3/2001 Longbottom
6,209,636 B1 4/2001 Roberts et al. ..... 166/117.6
6,237,284 B1 5/2001 Erickson
6,244,340 B1 6/2001 McGlothen et al.
6,247,532 B1 6/2001 Ohmer
6,263,965 B1 * 7/2001 Schmidt et al. ..... 166/272.3
6,279,658 B1 8/2001 Donovan et al.
6,280,000 B1 8/2001 Zupanick ..... 299/12
6,283,216 B1 9/2001 Ohmer
6,318,457 B1 11/2001 Den Boer et al.
6,349,769 B1 2/2002 Ohmer ..... 166/313
6,357,523 B1 3/2002 Zupanick ..... 166/52
6,357,530 B1 3/2002 Kennedy et al. ..... 166/369
6,425,448 B1 7/2002 Zupanick et al. ..... 175/61
6,439,320 B1 8/2002 Zupanick ..... 166/313
6,450,256 B1 9/2002 Mones ..... 166/250.01
6,454,000 B1 9/2002 Zupanick ..... 166/243
6,457,540 B1 10/2002 Gardes
6,470,978 B1 10/2002 Trueman et al.
6,478,085 B1 11/2002 Zupanick ..... 166/50
6,491,101 B1 12/2002 Ohmer
6,497,556 B1 12/2002 Zupanick ..... 417/85
6,554,063 B1 4/2003 Ohmer
6,557,628 B1 5/2003 Ohmer
6,561,288 B1 5/2003 Zupanick ..... 175/69
6,564,867 B1 5/2003 Ohmer
6,566,649 B1 5/2003 Mickael ..... 250/269.3
6,571,888 B1 6/2003 Comeau et al. ..... 175/61
6,575,235 B1 6/2003 Zupanick ..... 166/50
6,575,255 B1 6/2003 Rial et al.
6,577,129 B1 6/2003 Thompson ..... 324/338
6,585,061 B1 7/2003 Radzinski ..... 175/45
6,590,202 B1 7/2003 Mickael ..... 250/269.4
6,591,903 B1 7/2003 Ingle ..... 166/50
6,591,922 B1 7/2003 Rial et al.
6,595,301 B1 7/2003 Diamond et al.
6,595,302 B1 7/2003 Diamond et al.
6,598,686 B1 7/2003 Zupanick ..... 175/62
6,604,580 B1 8/2003 Zupanick ..... 166/245
6,604,910 B1 8/2003 Zupanick ..... 417/36
6,607,042 B1 8/2003 Hoyer et al. ..... 175/38
6,636,159 B1 10/2003 Winnacker ..... 340/854.3
6,639,210 B1 10/2003 Odom et al. ..... 250/269.6
6,644,422 B1 11/2003 Rial et al.
6,646,441 B1 11/2003 Thompson et al.
6,653,839 B1 11/2003 Yuratich et al. ..... 324/355
6,662,870 B1 12/2003 Zupanick ..... 166/245
6,668,918 B1 12/2003 Zupanick ..... 166/50

| | | | | |
|---|---|---|---|---|
| 6,679,322 | B1 | 1/2004 | Zupanick | 166/50 |
| 6,681,855 | B1 | 1/2004 | Zupanick | 166/50 |
| 6,688,388 | B1 | 2/2004 | Zupanick | 166/50 |
| 6,722,452 | B1 | 4/2004 | Rial et al. | |
| 6,758,279 | B1 | 7/2004 | Moore et al. | |
| 2002/0043404 | A1 | 4/2002 | Trueman et al. | |
| 2002/0050358 | A1 | 5/2002 | Algeroy | 166/313 |
| 2002/0074120 | A1 | 6/2002 | Scott | 166/313 |
| 2002/0074122 | A1 | 6/2002 | Kelly et al. | 166/313 |
| 2002/0096336 | A1 | 7/2002 | Zupanick | 175/161 |
| 2002/0108746 | A1 | 8/2002 | Zupanick | 166/50 |
| 2002/0117297 | A1 | 8/2002 | Zupanick | 166/50 |
| 2002/0189801 | A1 | 12/2002 | Zupanick | 166/50 |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0106686 | A1 | 6/2003 | Ingle et al. | 166/245 |
| 2003/0164253 | A1 | 9/2003 | Trueman et al. | |
| 2003/0221836 | A1 | 12/2003 | Gardes | |
| 2004/0007389 | A1 | 1/2004 | Zupanick | 175/61 |
| 2004/0007390 | A1 | 1/2004 | Zupanick | 175/61 |
| 2004/0011560 | A1 | 1/2004 | Rial et al. | |
| 2004/0020655 | A1 | 2/2004 | Rusby et al. | |
| 2004/0033557 | A1 | 2/2004 | Scott et al. | |
| 2004/0055787 | A1 | 3/2004 | Zupanick | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |
| 2005/0087340 | A1* | 4/2005 | Zupanick et al. | 166/245 |
| 2005/0133219 | A1 | 6/2005 | Zupanick | |
| 2005/0189114 | A1* | 9/2005 | Zupanick | 166/313 |

FOREIGN PATENT DOCUMENTS

| | | | |
|---|---|---|---|
| CA | 2 278 735 | | 1/1998 |
| CA | 2210866 | | 1/1998 |
| DE | CH 653 741 | | 1/1986 |
| DE | 19725996 | A1 | 1/1998 |
| EP | 0819834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 255 033 | | 10/1992 |
| GB | 2297 988 | | 8/1996 |
| GB | 2347157 | | 8/2002 |
| RU | SU-750108 | | 6/1975 |
| RU | SU-1448078 | A1 | 3/1987 |
| RU | SU-1770570 | A1 | 3/1990 |
| SU | 750108 | | 6/1975 |
| SU | 876968 | | 10/1981 |
| SU | 1448078 | A1 | 3/1987 |
| SU | 1770570 | A1 | 3/1990 |
| WO | 94/21889 | | 9/1994 |
| WO | WO 94/28280 | | 12/1994 |
| WO | WO 97/21900 | | 6/1997 |
| WO | WO 98/25005 | | 6/1998 |
| WO | WO 98/35133 | | 8/1998 |
| WO | WO 99/60248 | | 11/1999 |
| WO | 00/31376 | | 6/2000 |
| WO | WO 00/79099 | | 12/2000 |
| WO | WO 01/44620 | | 6/2001 |
| WO | WO 02/18738 | | 3/2002 |
| WO | WO 02/059455 | | 8/2002 |
| WO | WO 02/061238 | A1 | 8/2002 |
| WO | WO 03/061238 | | 8/2002 |
| WO | WO 03/036023 | A1 | 5/2003 |
| WO | WO 03/102348 | | 12/2003 |
| WO | WO 2004/035984 | A1 | 4/2004 |
| WO | WO 2005/003509 | | 1/2005 |

OTHER PUBLICATIONS

Notification of Transmittal of the International Search Report or the Declaration (PCT Rule 44.1) mailed Feb. 27, 2004 (9 pages) re International Application No. PCT/US 03/30126, Sep. 23, 2003.

Fletcher, "Anadarko Cuts Gas Route Under Canadian River Gorge," Oil and Gas Journal, pp. 28-30, Jan. 25, 2004.

Translation of selected pages of Kalinin, et al., "Drilling Inclined and Horizontal Well Bores," Nedra Publishers, Moscow, 1997, 15 pages.

Translation of selected pages of Arens, V.Zh., "Well-Drilling Recovery of Minerals," Geotechnology, Nedra Publishers, Moscow, 7 pages, 1986.

Listing of 174 References received from Third Party on Feb. 16, 2005 (9 pages).

Gardes Directional Drilling, "Multiple Directional Wells From Single Borehole Developed," Reprinted from Jul. 1989 edition of Offshore, Copyright 1989 by PennWell Publishing Company (4 pages).

"Economic Justification and Modeling of Multilateral Wells," Economic Analysis, Hart's Petroleum Engineer International, 1997 (4 pages).

Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).

P. Corlay, D. Bossie-Codreanu, J.C. Sabathier and E.R. Delamaide, "Improving Reservoir Management With Complex Well Architectures," Field Production & Reservoir Management, World Oil, Jan. 1997 (5 pages).

Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).

Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).

H.H. Fields, Stephen Krickovic, Albert Sainato, and M.G. Zabetakis, "Degasification of Virgin Pittsburgh Coalbed Through a Large Borehole," RI-7800, Bureau of Mines Report of Investigations/1973, United States Department of the Interior, 1973 (31 pages).

William P. Diamond, "Methane Control for Underground Coal Mines," IC-9395, Bureau of Mines Information Circular, United States Department of the Interior, 1994 (51 pages).

Technology Scene Drilling & Intervention Services, "Weatherford Moves Into Advanced Multilateral Well Completion Technology," *Reservoir Mechanics*, Weatherford International, Inc., 2000 Annual Report (2 pages).

"A Different Direction for CBM Wells," *W Magazine*, 2004 Third Quarter (5 pages).

Snyder, Robert E., "What's New in Production," *WorldOil Magazine*, Feb. 2005, [retrieved from the internet on Mar. 7, 2005], http://www.worldoil.com/magazine/MAGAZINE_DETAIL.asp?ART_ID=2507@MONTH_YEAR (3 pages).

Nazzal, Greg, "Moving Multilateral Systems to the Next Level," Strategic Acquisition Expands Weatherford's Capabilities, 2000 (2 pages).
PowerPoint Presentation entitled, "Horizontal Coalbed Methane Wells," by Bob Stayton, Computalog Drilling Services, date is believed to have been in 2002 (39 pages).
Denney, Dennis, "*Drilling Maximum-Reservoir-Contact Wells in the Shaybah Field*," SPE 85307, pp. 60, 62-63, Oct. 20, 2003.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance of Mining," REI Drilling Directional Underground, World Coal, 1999, 10 pages.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico," dated on or about Mar. 6, 2003, pp. 1-11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/.../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—the U.S. Experience," Website, http://aapg.confex.com/.../, printed Nov. 16, 2004 (1 page).
U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 (2 pages).
Zupanick, J., "Coalbed Methane Extraction," 28th Mineral Law Conference, Lexington, Kentucky, Oct. 16-17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).
Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).
Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).
The Official Newsletter of the Cooperative Research Centre for Mining Technology and Equipment, CMTE News 7, "Tight-Radius Drilling Clinches Award," Jun. 2001, 1 page.
Dreiling, Tim, McClelland, M.L. and Bilyeu, Brad, "Horizontal & High Angle Air Drilling in the San Juan Basin, New Mexico," Believed to be dated Apr. 1996, pp. 1-11.
Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A Review of Horizontal Well Technology and Its Domestic Application," DOE/EIA-TR-0565, U.S. Department of Energy, Apr. 1993, 30 pages.
Santos, Helio, SPE, Impact Engineering Solutions and Jesus Olaya, Ecopetrol/ICP, "*No-Damage Drilling: How to Achieve this Challenging Goal*?, " SPE 77189, Copyright 2002, presented at the IADC/SPE Asia Pacific Drilling Technology, Jakarta, Indonesia, Sep. 9-11, 2002, 10 pages.
Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.
Franck Labenski, Paul Reid, SPE, and Helio Santos,SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe*, " SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.
Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.
Robert E. Snyder, "Drilling Advances," World Oil, Oct. 2003, 1 page.
U.S. Environmental Protection Agency, "Directional Drilling Technology," prepared for the EPA by Advanced Resources International under Contract 68-W-00-094, Coalbed Methane Outreach Program (CMOP), Website: http://search.epa.gov/s97is.vts, printed Mar. 17, 2005, 13 pages.
"Meridian Tests New Technology," Western Oil World, Jun. 1990, Cover, Table of Contents and p. 13.
Clint Leazer and Michael R. Marquez, "Short-Radius Drilling Expands Horizontal Well Applications," Petroleum Engineer International, Apr. 1995, 6 pages.
Terry R. Logan, "Horizontal Drainhole Drilling Techniques Used in Rocky Mountains Coal Seams," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.
Daniel J. Brunner, Jeffrey J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).
Karen Bybee, highlights of paper SPE 84424, "Coalbed-Methane Reservoir Simulation: An Evolving Science," by T.L. Hower, JPT Online, Apr. 2004, Website: http://www.spe.org/spe/jpt/jsp/jptpapersynopsis/0,2439,1104_11038_2354946_2395832,00.html, printed Apr. 14, 2005, 4 pages.
Kevin Meaney and Lincoln Paterson, "Relative Permeability in Coal," SPE 36986, Society of Petroleum Engineers, Copyright 1996, pp. 231-236.
Calender of Events—Conference Agenda, Fifth Annual Unconventional Gas and Coalbed Methane Conference, Oct. 22-24, 2003, in Calgary Alberta, Website: http://www.csug.ca/cal/calc0301a.html, printed Mar. 17, 2005, 5 pages.
Tom Engler and Kent Perry, "Creating a Roadmap for Unconventional Gas R&D," Gas TIPS, Fall 2002, pp. 16-20.
CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.
Solutions From the Field, "Coalbed Methane Resources in the Southeast," Copyright 2004, Website: http://www.pttc.org/solutions/sol_2004/537.htm, printed Mar. 17, 2005, 7 pages.
Jeffrey R. Levine, Ph.D., "Matrix Shrinkage Coefficient," undated, 3 pages.
G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7-10, 2004, pp. 1-6.
R.W. Cade, "Horizontal Wells: Development and Applications," Presented at the Fifth International Symposium on Geophysics for Mineral, Geotechnical and Environmental Applications, Oct. 24-28, 1993 in Tulsa, Oklahoma, Website: http://www.mgls.org/93Sym/Cade/cade.html, printed Mar. 17, 2005, 6 pages.
Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.
R. Purl, J.C. Evanoff and M.L. Brugler, "Measurement of Coal Cleat Porosity and Relative Permeability Characteristics," SPE 21491, Society of Petroleum Engineers, Copyright 1991, pp. 93-104.
Peter Jackson, "Drilling Technologies for Underground Coal Gasification," IMC Geophysics Ltd., International UCG Workshop—Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.
Notification of Transmittal of International Preliminary Examination Report (1 page) and International Preliminary Examination Report (3 pages) for International Application No. PCT/US03/13954 mailed Apr. 14, 2005.
Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PC/US02/33128.
Notification of Transmittal of International Preliminary Examination Report (1 page) and International Preliminary Examination Report (3 pages mailed Apr. 22, 2004 and Written Opinion mailed Sep. 4, 2003 for International Application No. PCT/US02/33128.
B. Goktas et al., "*Performances of Openhole Completed and Cased Horizontal/Undulating Wells in Thin-Bedded, Tight Sand Gas Reservoirs*," SPE 65619, Society of Petroleum Engineers, Oct. 17-19, 2000 (7 pages).
Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).
Balbinski, E.F., "*Prediction of Offshore Viscous Oil Field Performance*," European Symposium on Improved Oil Recovery, Aug. 18-20, 1999, 10 pages.
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Kalinin, et al., Translation of Selected Pages from Ch. 4, Sections 4.2 (p. 135), 10.1 (p. 402), 10.4 (pp. 418-419), "*Drilling Inclined and Horizontal Well Bores*," Moscow, Nedra Publishers, 1997, 4 pages.
Jet Lavanway Exploration, "*Well Survey*," Key Energy Surveys, Nov. 2, 1997, 3 pages.
Precision Drilling, "*We Have Roots in Cool Bed Methane Drilling*," Technology Services Group, Published on or before Aug. 5, 2002, 1 page.
U.S. Dept. of Enery, "*New Breed of CBM/CMM Recovery Technology*," Jul. 2003, 1 page.
Ghiselin, Dick, "*Unconventional Vision Frees Gas Reserves*," Natural Gas Quarterly, Sep. 2003, 2 pages.
CBM Review, World Coal, "*US Drilling into Asia*," Jun. 2003, 4 pages.

Skrebowski, Chris, "*US Interest in North Korean Reserves*," Petroleum, Energy Institute, Jul. 2003, 4 pages.
Zupanick, U.S. Patent Application entitled "Method and System for Accessing Subterranean Deposits from the Surface and Tools Therefor," U.S. Appl. No. 10/630,345, Jul. 29, 2003 (366 pages).
Seams, Douglas, U.S. Patent Application entitled "Method and System for Extraction of Resources from a Subterranean Well Bore," U.S. Appl. No. 10/723,322, Nov. 26, 2003 (40 pages).
Zupanick, U.S. Patent Application entitled "Slant Entry Well System and Method," U.S. Appl. No. 10/749,884, Dec. 31, 2003 (28 pages).
Zupanick, U.S. Patent Application entitled "Method and System for Accessing Subterranean Deposits from the Surface," U.S. Appl. No. 10/761,629, Jan. 20, 2004 (38 pages).
Zupanick, U.S. Patent Application entitled "Method and System for Testing A Partially Formed Hydrocarbon Well for Evaluation and Well Planning Refinement," U.S. Appl. No. 10/769,221, Jan. 30, 2004 (34 pages).
Platt, "Method and System for Lining Multilateral Wells," U.S. Appl. No. 10/722,841, Feb. 5, 2004 (30 pages).
Zupanick, "Three-Dimentsional Well System For Accessing Subterranean Zones," Feb. 11, 2004, U.S. Appl. No. 10/777,503 (27 pages).
Zupanick, "System And Method For Directional Drilling Utilizing Clutch Assembly," U.S. Appl. No. 10/811,118, Mar. 25, 2004 (35 pages).
Zupanick et al., "Slot Cavity," U.S. Appl. No. 10/419,529, Apr. 21, 2003 (44 pages).
Zupanick, "System and Method for Multiple Wells from a Common Surface Location," U.S. Appl. No. 10/788,694, Feb. 27, 2004 (26 pages).
Palmer, Ian D., et al., "*Coalbed Methane Well Completions and Stimulations*," Chapter 14, Hydrocarbons From Coal, American Association of Petroleum Geologists, 1993, pp. 303-339.
Field, T.W., "*Surface to In-seam Drilling—The Australian Experience*," undated, 10 pages.
Drawings included in CBM well permit issued to CNX stamped Apr. 15, 2004 by the West Virginia Department of Environmenal Protection (5 pages).
Website of Mitchell Drilling Contractors, "Service: Dymaxion—Surface to In-seam," http://www.mitchell drilling.com/dymaxion.htm, printed as of Jun. 17, 2004, 4 pages.
Website of CH4, "About Natural Gas—Technology," http://www.ch4.com/au/ng_technology.html, copyright 2003, printed as of Jun. 17, 2004, 4 pages.
Thomson, et al., "The Application of Medium Radius Directional Drilling for Coal Bed Methane Extraction," Lucas Technical Paper, copyrighted 2003, 11 pages.
U.S. Department of Energy, DE-FC26-01NT41148, "Enhanced Coal Bed Methane Production and Sequestration of CO2 in Unmineable Coal Seams" for Consol, Inc., accepted Oct. 1, 2001, 48 pages.
U.S. Department of Energy, "*Slant Hole Drilling*," Mar. 1999, 1 page.
Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1-11.
Bybee, Karen, "*Advanced Openhole Multilaterals*," Horizontal Wells, Nov. 2002, pp. 41-42.
Bybee, Karen, "*A New Generation Multilateral System for the Troll Olje Field*," Multilateral/Extended Reach, Jul. 2002, 2 pages.
Emerson,, A.B., et al., "*Moving Toward Simpler, Highly Functional Multilateral Completions*," Technical Note, Journal of Canadian Petroleum Technology, May 2002, vol. 41, No. 5, pp. 9-12.
Moritis, Guntis, "*Complex Well Geometries Boost Orinoco Heavy Oil Producing Rates*," XP-000969491, Oil & Gas Journal, Feb. 28, 2000, pp. 42-46.
Themig, Dan, "*Multilateral Thinking*," New Technology Magazine, Dec. 1999, pp. 24-25.
Smith, R.C., et al., "The Lateral Tie-Back System: The Ability to Drill and Case Multiple Laterals," IADC/SPE 27436, Society of Petroleum Engineers, 1994, pp. 55-64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright Page, pp. 269-285.
Hanes, John, "Outburst in Leichhardt Colliery: Lessons Learned," International Symposium-Cum-Workshop on Management and Control of High Gas Emissions and Outbursts in Underground Coal Mines, Wollongong, NSW, Australia, Mar. 20-24, 1995, Title Page, pp. 445-449.
Williams, Ray, et al., "*Gas Reservoir Properties for Mine Gas Emission Assessment*," Bowen Basin Symposium 2000, pp. 325-333.
Brown, K., et al., "*New South Wales Coal Seam Methane Potential*," Petroleum Bulletin 2, Department of Mineral Resources, Discovery 2000, Mar. 1996, pp. i-viii, 1-96.
Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.
Examiner of Record, Office Action Response regarding the Interpretation of the three Russian Patent Applications listed above under Foreign Patent Documents (9 pages).
McCray and Cole, "Oil Well Drilling and Technology," University of Oklahoma Press, pp. 315-319, 1959.
Berger and Anderson, "Modern Petroleum;" Penn Well Books, pp. 106-108, 1978.
Arfon H. Jones et al., A Review of the Physical and Mechanical Properties of Coal with Implications for Coal-Bed Methane Well Completion and Production, Rocky Mountain Association of Geologists, pp. 169-181, 1988.
Howard L. Hartman, et al.; "SME Mining Engineering Handbook;" Society for Mining, Metallurgy, and Exploration, Inc.; pp. 1946-1950, 2nd Edition, vol. 2, 1992.
Dave Hassan, Mike Chemichen, Earl Jensen, and Morley-Frank; "Multi-lateral technique lowers drilling costs, provides environmental benefits", Drilling Technology, pp. 41-47, Oct. 1999.
Gopal Ramaswamy, "Production History Provides CBM Insights," Oil & Gas Journal, pp. 49, 50 and 52, Apr. 2, 2001.
Weiguo Chi and Luwu Yang, "Feasiblity of Coalbed Methane Exploitation in China," Horizontal Well Technology, p. 74, Sep. 2001.
Nackerud Product Description, Harvest Tool Company, LLC, 1 page, received Sep. 27, 2001.
Gopal Ramaswamy, "Advanced Key for Coalbed Methane," The American Oil & Gas Reporter, pp. 71 & 73, Oct. 2001.
Joseph C. Stevens, Horizontal Applications For Coal Bed Methane Recovery, Strategic Research Institute, pp. 1-10 (slides), Mar. 25, 2002.
R.J. "Bob" Stayton, "Horizontal Wells Boost CBM Recovery", Special Report: Horizontal & Directional Drilling, The American Oil & Gas Reporter, pp. 71-75, Aug. 2002.
P. Jackson and S. Kershaw, Reducing Long Term Methane Emissions Resulting from Coal Mining, Energy Convers. Mgmt, vol. 37, Nos. 6-8, pp. 801-806, 1996.
Susan Eaton, "Reversal of Fortune", New Technology Magazine, pp. 30-31, Sep. 2002.
James Mahony, "A Shadow of Things to Come", New Technology Magazine, pp. 28-29, Sep. 2002.
Documents Received from Third Party, Great Lakes Directional Drilling, Inc., (12 pages), received Sep. 12, 2002.
Robert W. Taylor and Richard Russell, Multilateral Technologies Increase Operational Efficiencies in Middle East, Oil & Gas Journal, pp. 76-80, Mar. 16, 1998.
Adam Pasiczynk, "Evolution Simplifies Multilateral Wells", Directional Drilling, pp. 53-55, Jun. 2000.
Steven S. Bell, "Multilateral System with Full Re-Entry Access Installed", World Oil, p. 29, Jun. 1996.

Pascal Breant, "Des Puits Branches, Chez Total : les puits multi drains", Total Exploration Production, pp. 1-5, Jan. 1999.
Chi, Weiguo, "A Feasible Discussion on Exploitation Coalbed Methane through Horizontal Network Drilling in China", SPE 64709, Society of Petroleum Engineers (SPE International), 4 pages, Nov. 7, 2000.
Chi, Weiguo, "Feasibility of Coalbed Methane Exploitation in China", synopsis of paper SPE 64709, 1 page, Nov. 7, 2000.
Ian D. Palmer et al., "Coalbed Methane Well Completions and Stimulations", Chapter 14, pp. 303-339, Hydrocarbons from Coal, Published by the American Association of Petroleum Geologists, 1993.
Zupanick, U.S. Appl. No. 10/264,535, "Method and System for Removing Fluid From a Subterranean Zone Using an Enlarged Cavity", Aug. 15, 2003.
Notification of Transmittal of the International Search Report or the Declaration (PCT Rule 44.1) mailed Nov. 6, 2003 (8 pages) re International Application No. PCT/US 03/21626, Jul. 11, 2003.
Notification of Transmittal of the International Search Report or the Declaration (PCT Rule 44.1) mailed Nov. 5, 2003 (8 pages) re International Application No. PCT/US 03/21627, Jul. 11, 2003.
Notification of Transmittal of the International Search Report or the Declaration (PCT Rule 44.1) mailed Nov. 4, 2003 (7 pages) re International Application No. PCT/US 03/21628, Jul. 11, 2003.
Notification of Transmittal of the International Search Report or the Declaration (PCT Rule 44.1) mailed Dec. 5, 2003 (8 pages) re International Application No. PCT/US 03/21750, Jul. 11, 2003.
Notification of Transmittal of the International Search Report or the Declaration (PCT Rule 44.1) mailed Dec. 19, 2003 (8 pages) re International Application No. PCT/US 03/28137, filed Sep. 9, 2003.
Notification of Transmittal of the International Search Report or the Declaration (PCT Rule 44.1) mailed Feb. 4, 2004 (8 pages) re International Application No. PCT/US 03/26124, filed Sep. 9, 2003.
Smith, Maurice, "*Chasing Unconventional Gas Unconventionally*," CBM Gas Technology, New Technology Magazine, Oct/Nov. 2003, pp. 1-4.
Gardes, Robert "A New Direction in Coalbed Methane and Shale Gas Recovery," (to the best of Applicants' recollection, first received at The Canadian Institute Coalbed Methane Symposium conference on Jun. 16 -17, 2002), 1 page of conference flyer, 6 pages of document.
Gardes, Robert, "Under-Balance Multi-Lateral Drilling for Unconventional Gas Recovery," (to the best of Applicants' recollection, first received at The Unconventional Gas Revolution conference on Dec. 9, 2003), 4 pages of conference flyer, 33 pages of document.
Boyce, Richard, "*High Resolution Selsmic Imaging Programs for Coalbed Methane Development*," (to the best of Applicants' recollection, first received at The Unconventional Gas Revolution conference on Dec. 10, 2003), 4 pages of conference flyer, 24 pages of document.
Mark Mazzella and David Strickland, "*Well Control Operations on a Multiwell Platform Blowout*," WorldOil.com—Online Magazine Article, vol. 22, Part I—pp. 1-7, and Part II—pp. 1-13, Jan. 2002.
Vector Magnetics LLC, Case History, California, May 1999, "*Sucessful Kill of a Surface Blowout*," pp. 1-12.
Cudd Pressure Control, Inc, "*Successful Well Control Operations-A Case Study: Surface and Subsurface Well Intervention on a Multi-Well Offshore Platform Blowout and Fire*," pp. 1-17, http://www.cuddwellcontrol.com/literature/successful/successful_well.htm, 2000.
R. Purl, et al., "*Damage to Coal Permeability During Hydraulic Fracturing*," pp. 109-115 (SPE 21813), 1991.
U.S. Dept. of Energy—Office of Fossil Energy, "*Multi-Seam Well Completion Technology: Implications for Powder River Basin Coalbed Methane Production*," pp. 1-100, A-1 through A10, Sep. 2003.
U.S. Dept. of Energy—Office of Fossil Energy, "*Powder River Basin Coalbed Methane Development and Produced Water Management Study*," pp. 1-111, A-1 through A14, Sep. 2003.
Zupanick, U.S. Patent Application entitled "Method and System for Underground Treatment of Materials," U.S. Appl. No. 10/142,817, filed May 8, 2002.
Zupanick, U.S. Patent Application entitled "Multi-Well Structure for Accessing Subterranean Deposits," U.S. Appl. No. 09/788,897, filed Feb. 20, 2001.
Zupanick, U.S. Patent Application entitled "Slant Entry Well System and Method," U.S. Appl. No. 10/004,316, filed Oct. 30, 2001.
Zupanick, U.S. Patent Application entitled "Undulating Well Bore", U.S. Appl. No. 10/194,366, filed Jul. 12, 2002.
Zupanick, U.S. Patent Application entitled "Accelerated Production of Gas from a Subterranean Surface", U.S. Appl. No. 10/246,052, filed Sep. 17, 2002.
Zupanick, U.S. Patent Application entitled "Ramping Well Bores", U.S. Appl. No. 10/194,367, filed Jul. 12, 2002.
Zupanick, U.S. Patent Application entitled "System and Method for Subterranean Access", U.S. Appl. No. 10/227,057, filed Aug. 22, 2002.
Zupanick, U.S. Patent Application entitled "Method and System for Controlling Pressure in a Dual Well System", U.S. Appl. No. 10/244,082, filed Sep. 12, 2002.
Zupanick, U.S. Patent Application entitled "Wellbore Sealing System and Method," U.S. Appl. No. 10/194,368, filed Jul. 12, 2002.
Zupanick, U.S. Patent Application entitled "Wellbore Sealing System and Method," U.S. Appl. No. 10/194,422 PUBLISHED, Jul. 12, 2002.
Zupanick, U.S. Patent Application entitled "Three-Dimensional Well System for Accessing Subterranean Zones," U.S. Appl. No. 10/244,083, filed Sep. 12, 2002.
Zupanick, U.S. Patent Application entitled "Method of Drilling Lateral Wellbores from a Slant Well Without Utilizing a Whipstock", U.S. Appl. No. 10/267,426, filed Oct. 8, 2002.
Zupanick, U.S. Patent Application entitled "Method and System for Circulating Fluid in a Well System", U.S. Appl. No. 10/323,192, filed Dec. 18, 2002.
Zupanick, U.S. Patent Application entitled "Method and System for Removing Fluid from a Subterranean Zone Using and Enlarged Cavity", U.S. Appl. No. 10/264,535, filed Oct. 3, 2002.
Zupanick, U.S. Patent Application entitled Method and System for Controlling the Production Rate . . . , U.S. Appl. No. 10/328,408, filed Dec. 23, 2002.
Rial, U.S. Patent Application entitled Method and System for Accessing a Subterranean Zone from a Limited Surface Area, U.S. Appl. No. 10/188,141, filed Jul. 1, 2002.
Zupanick, U.S. Patent Application entitled "Three-Dimensional Well System for Accessing Subterranean Deposits from the Surface and Tools Therefor," U.S. Appl. No. 10/630,345, filed Jul. 29, 2003.
Rial, U.S. Patent Application entitled "Method and System for Recirculating Fluid in a Well System," U.S. Appl. No. 10/457,103,filed Jun. 5, 2003.
Zupanick, U.S. Patent Application entitled "Wellbore Sealing System and Method," U.S. Appl. No. 10/406,037, filed Jul. 12, 2002.
Zupanick, U.S. Patent Application entitled "Method and System for Accessing Subterranean Deposits from the Surface," U.S. Appl. No. 10/641,856, filed Aug. 15, 2003.
Notes on Consol Presentation (by P. Thakur) made at IOGA PA in Pittsburgh, Pennsylvania on May 22, 2002 (3 pages).
Notification of Transmittal of the International Preliminary Report of Patentability (1 page) and International Preliminary Report on Patentability (12 pages) mailed Jan. 9, 2006 for International Application No. PCT/US2004/036616.
Notification Concerning Transmittal of Copy of International Preliminary Report on Patentability (Chapter 1 of the Patent Cooperation Treaty) (1 page), International Preliminary Report on Patentability (1 page), and Written Opinion of the International Searching Authority (7 pages) mailed Dec. 22, 2005 for International Application No. PCT/US2004/017048.
European Search and Examination Report, completed Dec. 5, 2005 for Application No. EP 05020737, 5 pages.

* cited by examiner

MULTI-PURPOSE WELL BORES AND METHOD FOR ACCESSING A SUBTERRANEAN ZONE FROM THE SURFACE

TECHNICAL FIELD OF THE INVENTION

Present invention relates generally to accessing a subterranean zone from the surface for production and/or injection of gas or other fluids, and more particularly to multi-purpose well bores and method for accessing a subterranean zone from the surface.

BACKGROUND OF THE INVENTION

Subterranean deposits of coal, shale and other formations often contain substantial quantities of methane gas. Vertical wells and vertical well patterns have been used to access coal and shale formations to produce the methane gas. More recently, horizontal patterns and interconnected well bores have also been used to produce methane gas from coal and shale formations and/or to sequester carbon dioxide.

SUMMARY OF THE INVENTION

Multi-purpose well bores and method for accessing a subterranean zone from the surface are provided. In a particular embodiment, a set of multi-purpose well bores is provided that each extend from a surface to a subterranean zone, is coupled to a subterranean pattern in the zone formed at least substantially through another one of the multi-purpose well bores, and is used to at least substantially form a subterranean pattern in the zone for another one of the multi-purpose well bores.

In accordance with one embodiment of the present invention, a well system includes at least two well bores extending from a surface to a subterranean zone. Each of the two well bores is used to form a well bore pattern for the subterranean zone that intersects the other well bore and transports fluid from the subterranean zone to the other well bore for production to the surface. In addition, each of the two well bores is operable to collect fluids transported to the well bore by the well bore pattern formed through the other well bore for production to the surface.

Technical advantages of one or more embodiments may include providing a well system with two or more multi-purpose well bores. Each multi-purpose well bore may be used to produce gas and other fluids collected by a subterranean pattern that is coupled to the multi-purpose well bore as well to form a disparate subterranean pattern that is coupled to another multi-purpose well bore and has collected fluids produced by the other multi-purpose well bore. In a particular embodiment, a pair of dual purpose well bores are each used to form a substantially horizontal drainage pattern in a subterranean zone for the other dual purpose well bore and to produce gas and other fluids collected by a disparate substantially horizontal drainage pattern connected to the dual purpose well bore. Utilizing the wells for multiple purposes may reduce or limit wells needed for a project and accordingly reduce drilling costs and time. As a result, use of capital per field may be reduced. In addition, an accelerated rate of return may be provided for a given investment in a field.

The above and elsewhere describe technical advantages may be provided and/or evidenced by some, all or none of the various embodiments. In addition, other technical advantages may be readily apparent from the following figures, descriptions, and claims.

DETAILED DESCRIPTION OF THE INVENTION

Figure 1:
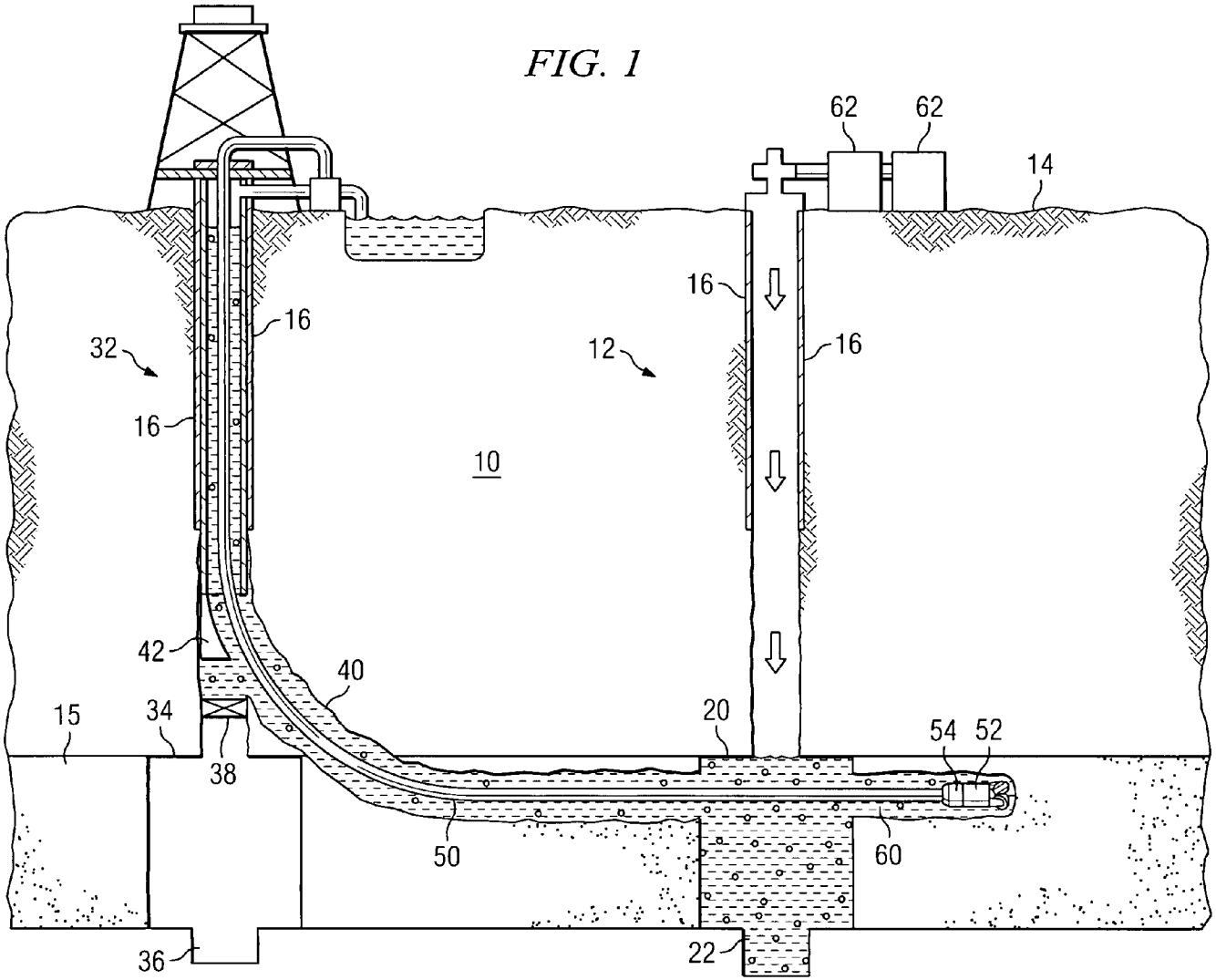
FIG. 1 illustrates one embodiment of a well system with a first well bore being used to form a subterranean pattern for a second well bore.

FIG. 1 illustrates an embodiment of formation of a well system 10 for enhanced access to a subterranean, or subsurface zone. In this embodiment, the subterranean zone is a coal seam. The subterranean zone may be other suitable types of zones accessed to produce hydrocarbons such as methane gas and other products, to store or process fluids or for other purposes. For example, the subterranean zone may be a shale or other carbonaceous formation.

Referring to FIG. 1, the well system 10 includes a first well bore 12 and a second well bore 32 extending from the surface 14 to a target coal seam 15. The first and second well bores 12 and 32 intersect, penetrate and continue below the coal seam 15. The first and second well bores 12 and 32 may be lined with a suitable well casing 16 that terminates at or above the level of the coal seam 15. The first and second well bores 12 and 32 may be substantially vertical or non-articulated in that they allow sucker rod, Moineau and other suitable rod, screw and/or other efficient bore hole pumps or pumping system to lift fluids up the bore to the surface 14. Thus, the first and/or second well bores 12 and 32 may include suitable angles to accommodate surface 14 characteristics, geometric characteristics of the coal seam 15, characteristics of intermediate formations and may be slanted at a suitable angle or angles along their length or parts of their length. In particular embodiments, the first well and/or second bores 12 and 32 may slant up to 35 degrees along their length or in sections but not themselves be fully articulated to horizontal. The first and second well bores 12 and 32 as well as other well bores may each be substantially uniform in size and shape, differ suitably along their length, be formed in a single drilling operation, or be otherwise suitably formed.

The first and second well bores 12 and 32 may be logged either during or after drilling in order to closely approximate and/or locate the exact vertical depth of the coal seam 15. As a result, the coal seam 15 is not missed in subsequent drilling operations. In addition, techniques used to locate the coal seam 15 while drilling may be omitted. The coal seam 15 may be otherwise suitably located.

A first cavity 20 is formed in the first well bore 12 in or otherwise proximate to the coal seam 15. A second cavity 34 is formed in the second well bore 32 in or otherwise proximate to the coal seam 15. As described in more detail below, the cavities 20 and 34 are enlarged areas of the bore holes and may provide a point for intersection of each of the first and second well bores 12 and 32 by distinct articulated well bores used to form an associated well bore pattern in the coal seam 15. The enlarged cavities 20 and 34 may also provide a collection point for fluids drained from the coal seam 15 during production operations and may additionally function as a down hole gas/water separator and/or a surge chamber. In other embodiments, the cavities 20 and 34 may be omitted.

The cavities 20 and 34 may have any suitable configuration. In one embodiment, the cavities 20 and 34 each have an enlarged radius of approximately eight feet and a vertical dimension that equals or exceeds the vertical dimension of the coal seam 15. In another embodiment, the cavities 20 and 34 may have an enlarged substantially rectangular cross section for intersection by an articulated well bore and a narrow width through which the articulated well bore passes. In these embodiments, the cavities 20 and 34 may be formed using suitable under-reaming techniques and equipment such as a dual blade tool using centrifugal force, ratcheting or a piston for actuation, a pantograph and the like. The cavities 20 and 34 may be otherwise formed by suitable fracing and the like. A portion of the first well bore 12 may continue below the cavity 20 to form a sump 22 for the cavity 20. A portion of the second well bore 32 may likewise continue below the cavity 34 to form a sump 36 for the cavity 34.

In the embodiment illustrated in FIG. 1, the second well bore 32 is offset a sufficient distance from the first well bore 12 at the surface 14 to permit articulated well bores with large radius curved sections to be drilled between the well bores 12 and 32. An articulated well bore is any suitable bore extending from a well bore having a first orientation to another substantially disparate orientation or other suitable deviated well bore. To provide the curved portion with a radius of 100–800 feet, the second well bore 32 may be offset a distance of about 300 to about 2000 feet from the first well bore 12. This spacing may reduce or minimizes the angle of the curved portion to reduce friction in each articulated well bore during drilling operations. As a result, reach of the drill string through the articulated well bores 40 is increased and/or maximized. In another embodiments, the second well bore 32 may be located otherwise at the surface with respect to the first well bore 12.

A first articulated well bore 40 is kicked-off the second well bore 32 above to cavity 34 and/or coal seam 15. A packer or plug 38 may be positioned in the second well bore 12 to prevent drilling fluid and debris from entering the cavity 34. In one embodiment, the first articulated well bore 40 is drilled using a drill string 50 that includes a suitable down-hole motor and bit 52. A measurement while drilling (MWD) device 54 may be included in the articulated drill string 50 for controlling the orientation and direction of the well bore drilled by the motor and bit 52. The articulated well bore 40 may be kicked off the second well bore 32 with a whipstock 42, other tool or drilling technique.

After the first cavity 20 of the first well bore 12 has been intersected by the first articulated well bore 40, drilling of the articulated well bore 40 is continued through the cavity 20 with drill string 50 to provide a first subterranean well bore pattern 60 in the coal seam 15 that is connected or otherwise coupled to the first well bore 12. In other embodiments, the first well bore 12 and/or cavity 20 may be otherwise positioned relative to the first well bore pattern 60. For example, in one embodiment, the first well bore 12 and cavity 20 may be positioned toward an end of the well bore pattern 60. Thus, the first well bore 12 and/or cavity 20 may be positioned within the pattern 60 at or between sets of laterals. Also, pattern 60 may be otherwise suitably formed or connected to the cavity 20. The first pattern 60 is in the coal seam 15 when a majority, substantially all or other substantial portion, is in the seam such that fluids may be transported from or to the seam by the pattern 60.

The first well bore pattern 60 may be substantially horizontal corresponding to the geometric characteristics of the coal seam 15. The well bore pattern 60 may include sloped, undulating, or other inclinations of the coal seam 15 or other subterranean zone. During formation of the well bore pattern 60, gamma ray logging tools and conventional MWD devices may be employed to control and direct the orientation of the drill bit 52 to retain the well bore pattern 60 within the confines of the coal seam 15 and to provide substantially uniform coverage of a desired area within the coal seam 15.

In one embodiment, as described in more detail below, the drainage pattern 60 may be an omni-directional well bore pattern operable to intersect a substantial or other suitable number of fractures in the area of the coal seam 15 covered by the pattern 60. The drainage pattern 60 may intersect a significant number of fractures of the coal seam 15 when it intersects a majority of the fractures in the coverage area and plane of the pattern 60. In other embodiments, the drainage pattern 60 may intersect a minority percentage of the fractures or a super majority percentage of the fractures in the coverage area and plane of the pattern 60. The coverage area may be the area between the well bores of the pattern 60.

The first subterranean pattern 60 may be a pinnate pattern, other suitable multi-lateral or multi-branching pattern, other pattern having a lateral or other network of bores or other patterns of one or more bores with a significant percentage of the total footage of the bores having disparate orientations. The percentage of the bores having disparate orientations is significant when twenty-five to seventy-five percent of the bores have an orientation at least twenty degrees offset from other bores of the pattern. In a particular embodiment, the well bores of the pattern 60 may have three or more main orientations each including at least 10 percent of the total footage of the bores. For a pinnate pattern, the lateral bores may become successively shorter as the pattern progresses out from the cavity or well that is intersected. In addition, the distance from the intersected well bore to the distal end of each lateral through the lateral and main bore may be substantially equal.

During the process of drilling the well bore pattern 60, drilling fluid or "mud" may be pumped down the drill string 50 and circulated out of the drill string 50 in the vicinity of the bit 52, where it is used to scour the formation and to remove formation cuttings. The cuttings are then entrained in the drilling fluid which circulates up through the annulus between the drill string 50 and the walls of first articulated well bore 40 and the second well bore 32 until it reaches the surface 14, where the cuttings are removed from the drilling fluid and the fluid is then recirculated. To prevent over-balance drilling conditions during formation of the well bore pattern 60, air compressors 62 may be provided at the surface 14 to circulate compressed air down the first well bore 12 and back up through the first articulated well bore 40. The circulated air will admix with the drilling fluids in the annulus around the drill string 50 and create bubbles throughout the column of drilling fluid. This has the effect of lightening the hydrostatic pressure of the drilling fluid and reducing the down-hole pressure sufficiently that drilling conditions do not become over-balanced. Aeration of the drilling fluid reduces down-hole pressure to less than the pressure of the hydrostatic column. For example, in some formations, down-hole pressure may be reduced to approximately 150–200 pounds per square inch (psi). Accordingly, low pressure coal seams and other subterranean resources can be drilled without substantial loss of drilling fluid and contamination of the resource by the drilling fluid.

Foam, which may be compressed air mixed with water or other suitable fluid, may also be circulated down through the drill string 50 along with the drilling mud in order to aerate the drilling fluid in the annulus as the first articulated well bore 40 is being drilled and, if desired, as the well bore pattern 60 is being drilled. Drilling of the well bore pattern 60 with the use of an air hammer bit or an air-powered down-hole motor will also supply compressed air or foam to the drilling fluid. In this case, the compressed air or foam which is used to power the down-hole motor and bit 52 and exits the drill string 50 in the vicinity of the drill bit 52. However, the larger volume of air which can be circulated down the first well bore 12 permits greater aeration of the drilling fluid than generally is possible by air supplied through the drill string 50.

Figure 2:
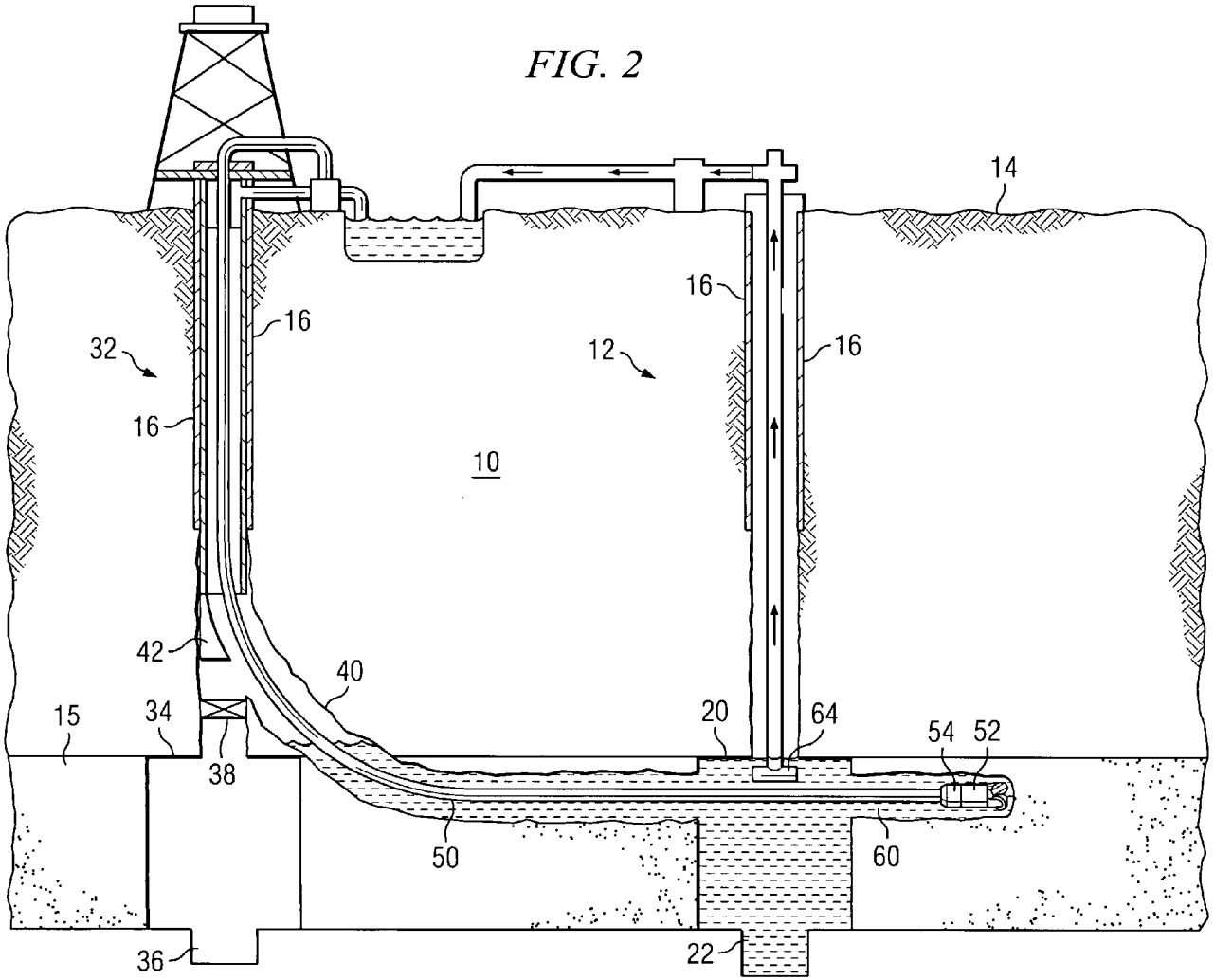
FIG. 2 illustrates the well system of FIG. 1 with the first well bore being used to form the subterranean pattern for the second well bore in accordance with another embodiment.

FIG. 2 illustrates underbalanced formation of the first articulated well 40 in the well system 10 in accordance with another embodiment. In this embodiment, after intersection of the cavity 20 by the first articulated well bore 40, a Moineau or other suitable pump 64 is installed in the cavity 20 to pump drilling fluid and cuttings to the surface 14 through the first well bore 12. This eliminates or reduces both the head pressure and the friction of air and fluid returning up the first articulated well bore 40 and reduces down-hole pressure to nearly zero. Accordingly, coal seams 15 and other subterranean resources having ultra low pressures below 150 psi can be accessed from the surface 14. Additionally, the risk of combining air and methane in the well may be eliminated or reduced.

Figure 3:
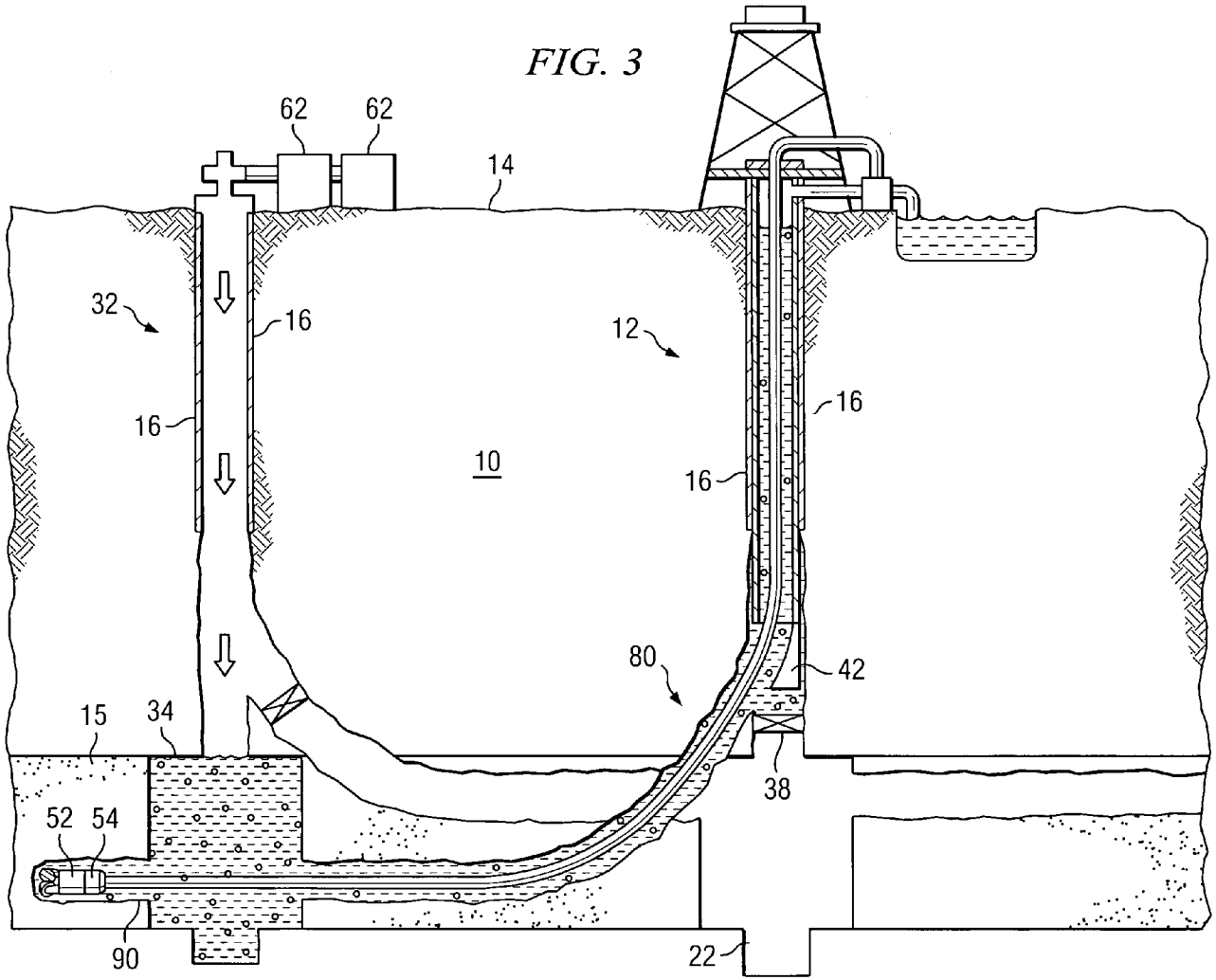
FIG. 3 illustrates one embodiment of the well system of FIG. 1 with the second well bore being used to form a subterranean pattern for the first well bore.

FIG. 3 illustrates formation of a second articulated well bore 80 in the well system 10. In the illustrated embodiment, the second articulated well 80 is formed off of the first well bore 12. Designation of first and second herein are provided for convenience to distinguish between elements of the same or similar type and do not necessarily designate order of formation or association between objects. Thus, for example, the second articulated well 80 may be formed immediately after the first well bore 12 is formed, and before formation of the second well bore 32 and the first articulated well 40. In such an embodiment, the second cavity 34 may be formed through the second articulated well 80 for intersection of the first well bore 32 or the second cavity 34 may be formed in the first well bore 32 to connect already drilled well bores 32 and 80. As previously described, the cavity may be omitted.

Referring to FIG. 3, after formation of the first articulated well 40 and associated first subterranean pattern 60 are completed, the drilling rig may again be positioned over the first well bore 12 for formation of the second articulated well bore 80. A packer 38 may be placed in the first well bore 12 between the first cavity 20 and the kick-off point for the second articulated well 80 to prevent cuttings from settling in the cavity 20 and sump 22. A whipstock 42 may be used to kick-off the second articulated well 80.

The second articulated well 80 may be substantially similar to the first articulated well 40 and include a curved or radiused portion and a substantially horizontal portion. The substantially horizontal portion, in one embodiment, intersects the second cavity 34 of the second well bore 32. As described in connection with a first articulated well bore 40, the substantially horizontal portion of the second articulated well bore 80 may be formed to any suitable angle relative to the surface 14 and the curved or radiused portion may directly intersect the cavity 34. The curved or radiused portion of the second articulated well bore 80 may in one embodiment have the same or similar radius to that of the first articulated well bore 40.

The second articulated well bore 80 may be drilled using the drill string 50 that includes the down-hole motor and bit 52 as well as the MWD device 54 described in connection with formation of the first articulated well bore 40. After the second cavity 34 of the second well bore 32 has been intersected by the second articulated well bore 80, drilling is continued through the cavity 32 with the drill string 50 to provide a second subterranean well bore pattern 90 in the coal seam 15. In other embodiments, the second well bore 32 and/or cavity 34 may be otherwise positioned relative to the second well bore pattern 90 and the second articulated well 80.

The second well bore pattern 90 may be substantially horizontal corresponding to the geometric characteristics of the coal seam 15. The second well bore pattern 90 may be drilled in and under-balanced or other suitable state as described in connection with the first well bore pattern 60. The second well bore pattern 90 may be a pinnate pattern, other suitable multi-lateral or multi-branching pattern or other pattern having a lateral or other network of bores, or other pattern of one or more bores with a significant percentage of the total footage of the bores having disparate orientations.

Figure 4A:
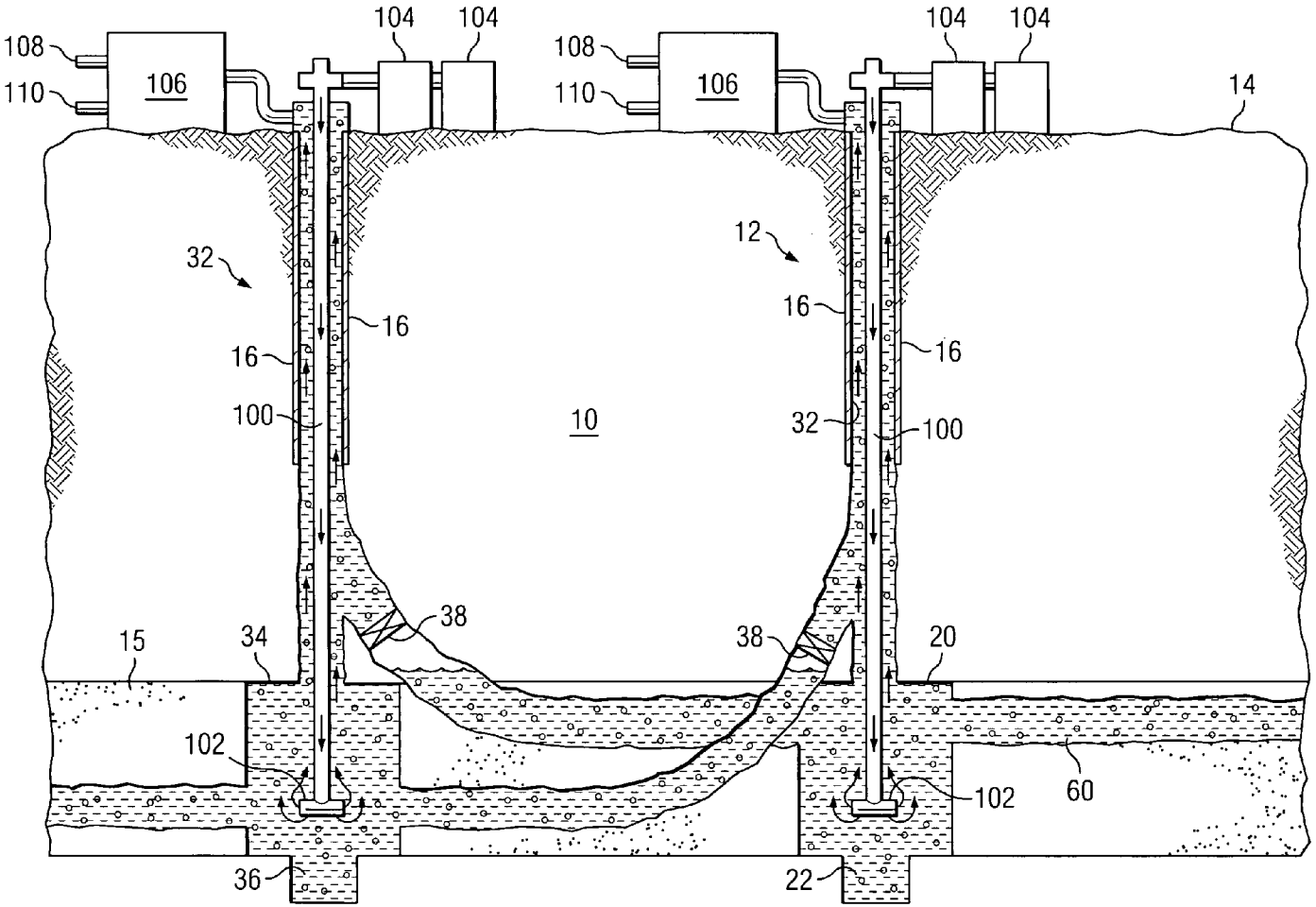
FIGS. 4A–B illustrate various embodiments of production from the subterranean zone through the first and second well bores of the well system of FIG. 3.
Figure 4B:
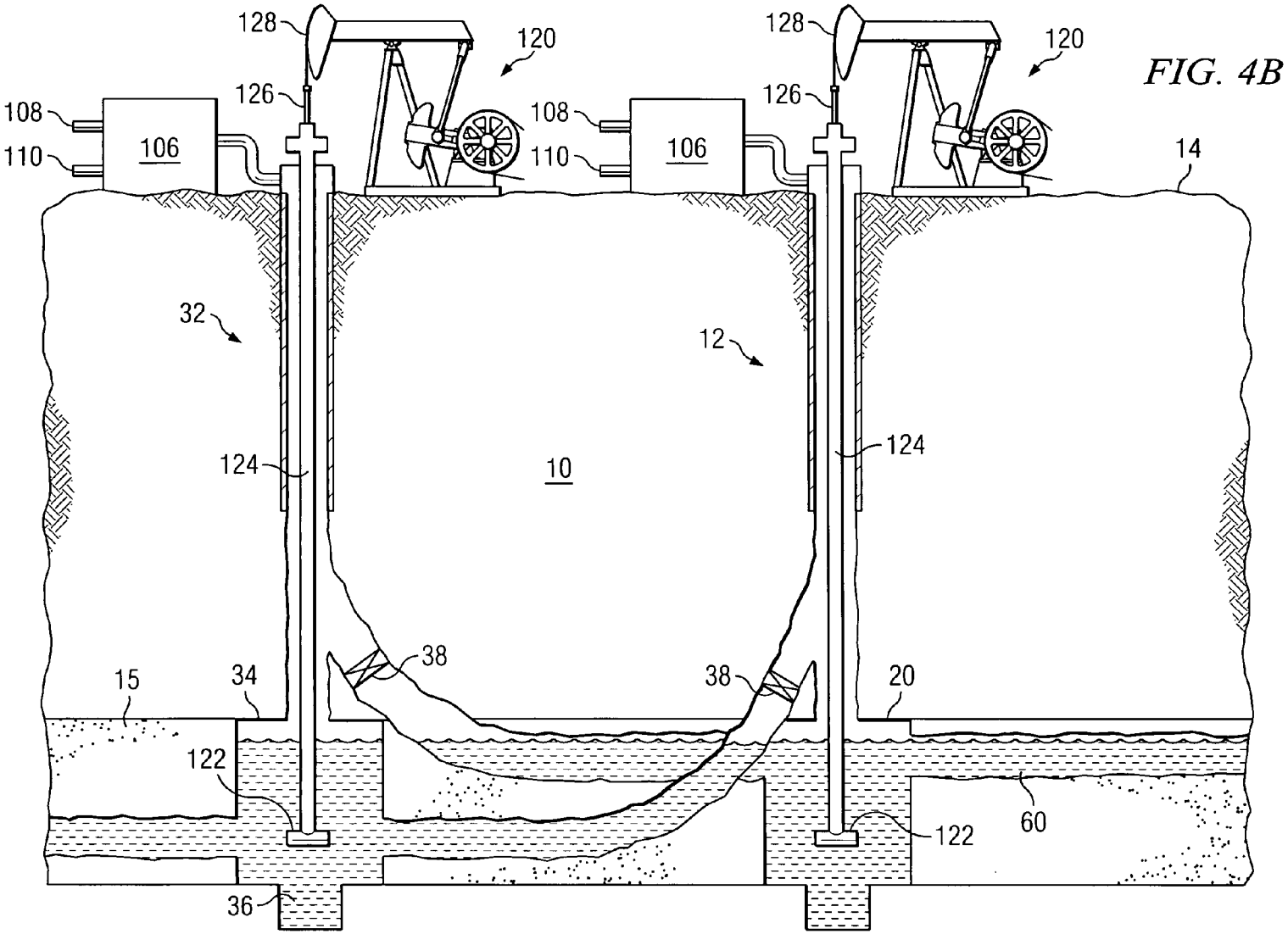

FIGS. 4A–B illustrate production of gas and other fluids from the coal seam 15 to the surface using the well system 10 in accordance with several embodiments of the present invention. In particular, FIG. 4A illustrates the use of gas lift to produce fluids from the coal seam 15. FIG. 4B illustrates the use of a rod pump to produce fluids from the coal seam 15. In one embodiment, production may be initiated by gas lift to clean out the cavity 20 and kick-off production. After production kick-off, the gas lift equipment may be replaced with a rod pump for further removal of fluids during the life of the well. Thus, while gas lift may be used to produce fluids during the life of the well, for economic reasons, the gas lift system may be replaced with a rod pump for further and/or continued removal of fluids from the cavity 20 over the life of the well. In these and other embodiments, evolving gas disorbed from coal in the seam 15 and produced to the surface 14 is collected at the well head and after fluid separation may be flared, stored or fed into a pipeline.

Referring to FIG. 4A, after the first and second well bores 12 and 32, and the first and second well bore pattern 60 and 90 have been drilled, a tubing string 100 may be disposed in each well bore 12 and 32 with a port 102 positioned in the corresponding cavity 20 and 34. Each cavity 20 and 34 provides a reservoir for water or other fluids collected through the corresponding drainage pattern 60 and 90 from the coal seam 15. In one embodiment, the tubing string 100 may be a casing string for a rod pump to be installed after the completion of gas lift and the port 102 may be the intake port for the rod pump. In this embodiment, the tubing may be, for example, a 2⅞ tubing used for a rod pump. It will be understood that other suitable types of tubing operable to carry air or other gases or materials suitable for gas lift may be used.

At the surface 14, one or more air compressors 104 are connected to each tubing string 100. Air compressed by the compressors 104 is pumped down each tubing string 100 and exits into the corresponding cavity 20 and 34 at the port 102. The air used for gas lift and/or for the previously described under balanced drilling may be ambient air at the site or may be or include any other suitable gas. For example, produced gas may be returned to the cavity and used for gas lift. In the cavities 20 and 34, the compressed air expands and suspends liquid droplets within its volume and lifts them to the surface. In one embodiment, for shallow coal beds 15 at or around one thousand feet, air may be compressed to three hundred to three hundred fifty psi and provided at a rate of nine hundred cubic feet per minute (CFM). At this rate and pressure, the gas lift system may lift up to three thousand, four thousand or five thousand barrels a day of water to the surface.

At the surface, air and fluids from each well bore 12 and 32 are fed into a fluid separator 106. Produced gas and lift air may be outlet at air/gas ports 108 and flared while remaining fluids are outlet at fluid ports 110 for transport or other removal, reinjection or surface runoff. It will be understood that water may be otherwise suitably removed from the cavities 20 and 34 and/or patterns 60 and 90 without production to the surface 14. For example, the water may be reinjected into an adjacent or other underground structure by pumping, directing or allowing the flow of the water to the other structure.

During gas lift, the rate and/or pressure of compressed air provided to the cavities 20 and 34 may be adjusted to control the volume of water produced to the surface. In one embodiment, a sufficient rate and/or pressure of compressed air may be provided to the cavities 20 and 34 to lift all or substantially all of the water collected by the cavities from a coal seam 15. This may provide for a rapid pressure drop in the coverage area of the coal seam 15 and allow for kick-off of the wells 12 and 34 to self-sustaining flow within one, two or a few weeks. In other embodiments, the rate and/or pressure of air provided may be controlled to limit water production below the attainable amount due to limitations in disposing of produced water and/or damage to the coal seam 15 or equipment by high rates of production. In a particular embodiment, a turbidity meter may be used at the well head to monitor the presence of particles in the produced water. If the amount of particles is over a specified limit, a controller may adjust a flow control valve to reduce the production rate. The controller may adjust the valve to specific flow rates and/or use feedback from the turbidity meter to adjust the flow control valve to a point where the amount of particles in the water is at a specified amount.

Referring to FIG. 4B, a pumping unit 120 is provided for each of the first and second well bores 12 and 32 and extends to the corresponding cavity 20 and 34. The cavities 20 and 34 provide a reservoir for accumulated fluids that may act as a surge tank and that may allow intermittent pumping without adverse effects of a hydrostatic head caused by accumulated fluids in the well bores 12 and 32. As a result, a large volume of fluids may be collected in the cavities 20 and 34 without any pressure or any substantial pressure being exerted on the formation from the collected fluids. Thus, even during non-extended periods of non-pumping, water and/or gas may continue to flow from the well bore patterns 60 and 90 and accumulate in the cavities 20 and 34.

The pumping units 120 include an inlet port 122 in each cavity 20 and 34 and may comprise a tubing string 124 with sucker rods 126 extending through the tubing string 124. Each inlet 122 may be positioned at or just above a center height of the corresponding cavity 20 or 34 to avoid gas lock and to avoid debris that collects in the sump. The inlet 122 may be suitably angled with or within the cavity.

The sucker rods 126 are reciprocated by a suitable surface mounted apparatus, such as a powered walking beam 128 to operate the pumping unit 120. In another embodiment, the pumping unit 120 may comprise a Moineau or other suitable pump operable to lift fluids vertically or substantially vertically. The pumping units 120 are used to remove water and entrained coal fines from the coal seam 15 via the well bore patterns 60 and 90. Once the water is removed to the surface 14, it may be treated in gas/water separator 106 for separation of methane which may be dissolved in the water and for removal of entrained fines.

After sufficient water has been removed from the coal seam 15, via gas lift, fluid pumping or other suitable manner, or pressure is otherwise lowered, coal seam gas may flow from the coal seam 15 to the surface 14 through the annulus of the first and second well bores 12 and 32 around the tubing strings and be removed via piping attached to a wellhead apparatus.

The pumping unit 120 may be operated continuously or as needed to remove water drained from the coal seam 15 into the enlarged cavities 20 and 34. In a particular embodiment, gas lift is continued until the wells are kicked-off to a self-sustaining flow at which time the wells are briefly shut-in to allow replacement of the gas lift equipment with the fluid pumping equipment. The wells are then allowed to flow in self-sustaining flow subject to periodic periods of being shut-in for maintenance, lack of demand for gas and the like. After any shut-in, a well may need to be pumped for a few cycles, a few hours, days or weeks, to again initiate self-sustaining flow or other suitable production rate of gas. In a particular embodiment, the rod pumps may each produce approximately eight gallons per minute of water from a corresponding cavity 20 or 34 to the surface. A well is at self sustaining flow when the flow of gas is operable to lift any produced water such that the well may operate for an extended period of six weeks or more without pumping or artificial gas lift. Thus, the well may require periodic pumping between periods of self sustaining flow.

Figure 5:
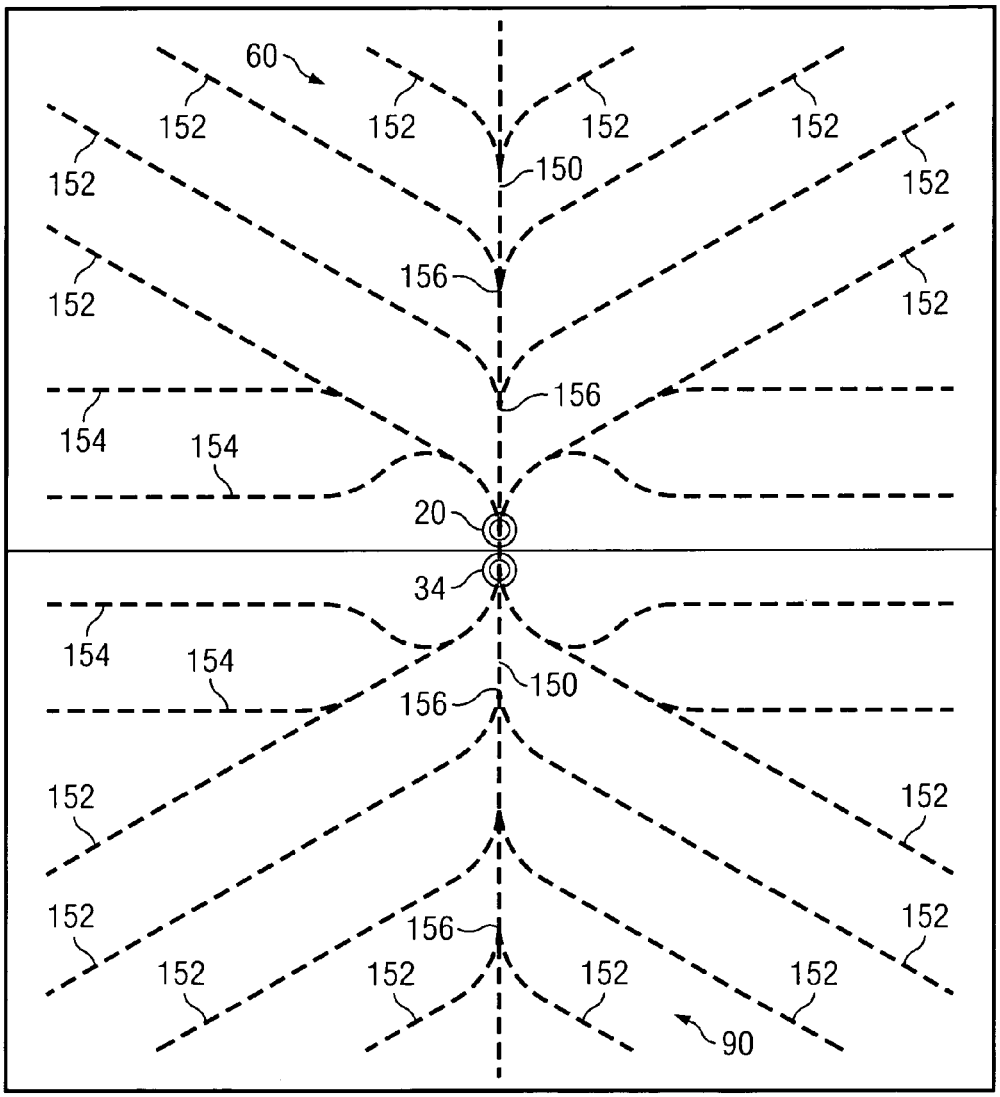
FIG. 5 illustrates one embodiment of the subterranean patterns of the well system of FIG. 3.

FIG. 5 illustrates one embodiment of the subterranean patterns 60 and 90 for accessing the coal seam 15 or other subterranean zone. The patterns 60 and 90 may be used to remove or inject water, gas or other fluids. The subterranean patterns 60 and 90 each comprises a multi-lateral pattern that has a main bore with generally symmetrically arranged and appropriately spaced laterals extending from each side of the main bore. As used herein, the term each means every one of at least a subset of the identified items. It will be understood that other suitable multi-branching or other patterns including or connected to a surface production bore may be used. For example, the patterns 60 and 90 may each comprise a single main bore.

Referring to FIG. 5, patterns 60 and 90 each include a main bore 150 extending from a corresponding cavity 20 or 34, or intersecting well bore 12 or 32, along a center of a coverage area to a distal end of the coverage area. The main bore 150 includes one or more primary lateral bores 152 extending from the main bore 150 to or at least approximately to the periphery of the coverage area. The primary lateral bores 152 may extend from opposite sides of the main bore 150. The primary lateral bores 152 may mirror each other on opposite sides of the main bore 150 or may be offset from each other along the main bore 150. Each of the primary lateral bores 152 may include a radius curving portion extending from the main bore 150 and a straight portion formed after the curved portion has reached a desired orientation. For uniform coverage, the primary lateral bores 152 may be substantially evenly spaced on each side of the main bore 150 and extend from the main bore 150 at an angle of approximately 45 degrees. The primary lateral bores 152 may shorten in length based on progression away from the corresponding cavity 20 or 34. Accordingly the distance between the cavity or intersecting well bore and the distal end of each primary lateral bore 152 through the pattern may be substantially equal for each primary lateral 152.

One or more secondary lateral bores 154 may be formed off one or more of the primary lateral bores 152. In a particular embodiment, a set of secondary laterals 154 may be formed off the first primary lateral bores 152 of each pattern 60 and 90 closest to the corresponding cavity 20 and 34. The secondary laterals 154 may provide coverage in the area between the primary lateral bores 152 of patterns 60 and 90. In a particular embodiment, a first primary lateral 154 may include a reversed radius section to provide more uniform coverage of the coal seam 15.

The subterranean patterns 60 and 90 with their central bore and generally symmetrically arranged and appropriately spaced auxiliary bores on each side may provide a substantially uniform pattern for draining fluids from a coal seam 15 or other subterranean formation. The number and spacing of the lateral bores may be adjusted depending on the absolute, relative and/or effective permeability of the coal seam and the size of the area covered by the pattern. The area covered by the pattern may be the area drained by the pattern, the area of a spacing unit that the pattern is designed to drain, the area within the distal points or periphery of the pattern and/or the area within the periphery of the pattern as well as the surrounding area out to a periphery intermediate to adjacent or neighboring patterns. The coverage area may also include the depth, or thickness of the coal seam or, for thick coal seams, a portion of the thickness of the seam. Thus, the pattern may include upward or downward extending branches in addition to horizontal branches. The coverage area may be a square, other quadrilateral, or other polygon, circular, oval or other ellipsoid or grid area and may be nested with other patterns of the same or similar type. It will be understood that other suitable well bore patterns may be used.

As previously described, the well bore 150 and the lateral bores 152 and 154 of patterns 60 and 90 are formed by drilling through the corresponding cavity 20 or 34 using the drill string 50 and an appropriate drilling apparatus. During this operation, gamma ray logging tools and conventional MWD technologies may be employed to control the direction and orientation of the drill bit 52 so as to retain the well bore pattern within the confines of the coal seam 15 and to maintain proper spacing and orientation of the well bores 150 and 152. In a particular embodiment, the main well bore 150 of each pattern 60 and 90 is drilled with an incline at each of a plurality of lateral branch points 156. After the main well bore 150 is complete, the drill string 50 is backed up to each successive lateral point 156 from which a primary lateral bore 152 is drilled on each side of the well bore 150. The secondary laterals 154 may be similarly formed. It will be understood that the subterranean patterns 60 and 90 may be otherwise suitably formed.

Figure 6:
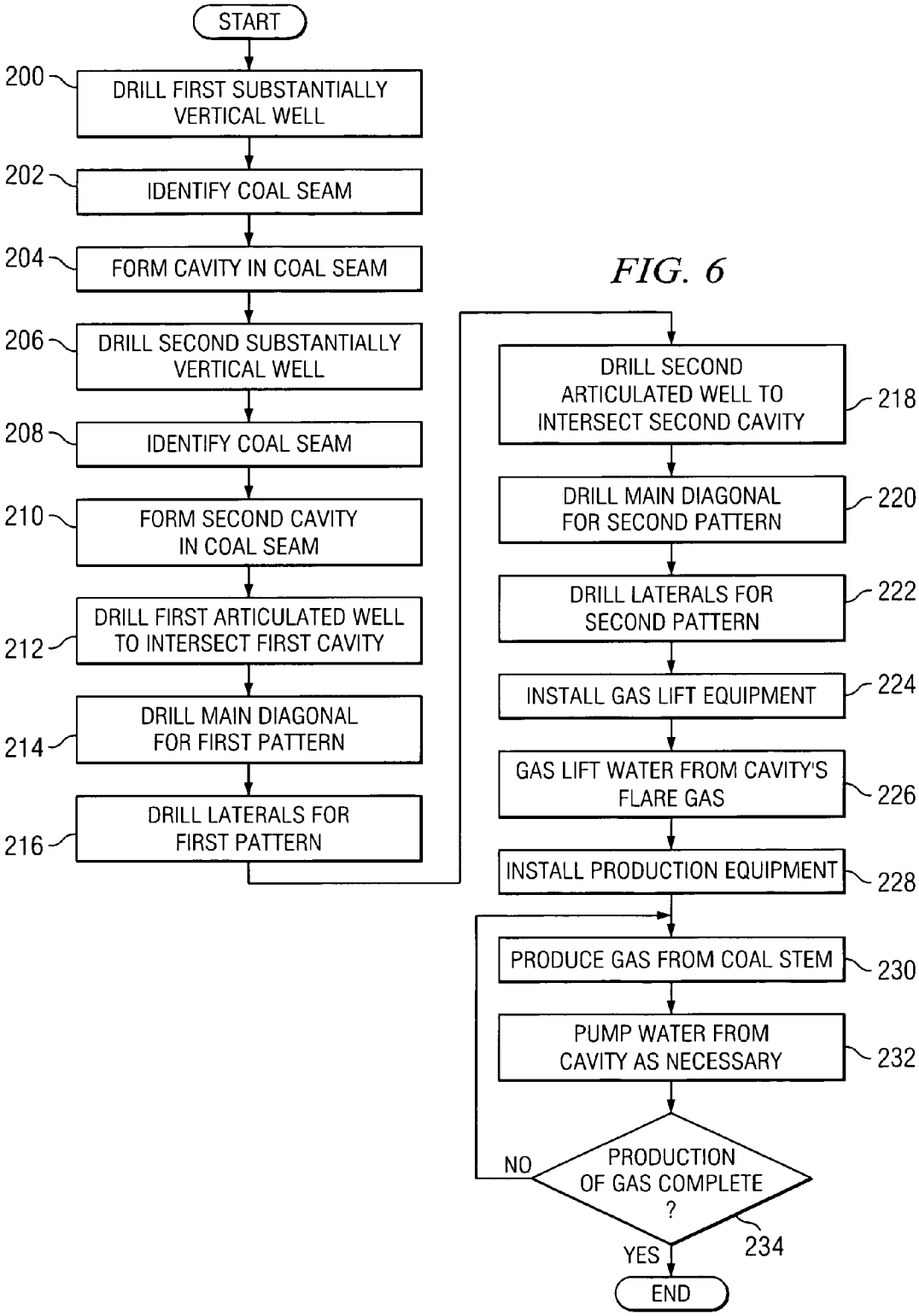
FIG. 6 illustrates one embodiment of a method for forming a well system with multi-purpose well bores.

FIG. 6 is a flow diagram illustrating a method for surface production of gas from a subterranean zone in accordance with one embodiment. In this embodiment, the subterranean zone is a coal seam and well system 10 with a pair of cavities is used to produce gas from the coal seam. It will be understood that the subterranean zone may comprise gas bearing shales and other suitable formations and that the well system 10 may have any suitable number of multi-purpose wells used to produce gas to the surface and to form bores for another producing well.

Referring to FIG. 6, the method begins after the region to be drained and the type of subterranean patterns for the region have been determined. In one embodiment, any suitable pinnate, other substantially uniform pattern providing less than ten or even five percent trapped zones in the coverage area, omni-directional or multi-branching pattern may be used to provide coverage for the region.

At step 200, in an embodiment in which dual purpose wells are used, a first substantially vertical or other suitable well 12 is drilled from the surface 14 through the coal seam 15. Slant and other suitable well configurations may, for example, instead be used. In a slant well configuration, the drainage patterns may be formed off of a slant well or a slanting portion of a well with a vertical or other section at the surface.

Next, at step 202, down hole logging equipment is utilized to exactly identify the location of the coal seam 15 in the first well bore 12. At step 204, the first enlarged diameter or other cavity 20 is formed in the first well bore 12 at the location of the coal seam 15. As previously discussed, the first cavity 20 may be formed by underreaming and other suitable techniques. For example, the cavity may be formed by fracing.

Next, at step 206, the second substantially vertical or other suitable well 32 is drilled from the surface 14 through the coal seam 15. Slant or other suitable well configurations may instead be used. At step 208, down-hole logging equipment is utilized to exactly identify the location of the coal seam 15 in the second well bore 32. At step 210, the second enlarged diameter or other cavity 34 is formed in the second well bore 32 at the location of the coal seam 15. The second cavity 34 may be formed by any other suitable technique.

Next, at step 212, the first articulated well bore 40 is drilled off the second well bore 32 to intersect the enlarged diameter cavity 20 of the first well bore 12. At step 214, the main well bore 150 for the first subterranean pattern 60 is drilled through the first articulated well bore 40 into the coal seam 15. As previously described, lateral kick-off points, or bumps may be formed along the main bore 150 during its formation to facilitate drilling of the lateral bores 152 and 154. After formation of the main well bore 150, lateral bores 152 and 154 for the subterranean pattern are drilled at step 216.

At step 218, the second articulated well bore 80 is drilled off the first well bore 12 to intersect the large diameter cavity 32 of the second well bore 32. At step 220, the main well bore 150 for the second subterranean pattern 90 is drilled through the second articulated well bore 80 into the coal seam 15. As previously described, lateral kick-off points or bumps may be formed along the main bore 150 in its formation to facilitate drilling of the lateral bores 152 and 154. At step 222, lateral bores 152 and 154 for the second pattern 90 are formed.

At step 224, gas lift equipment is installed in each of the first and second well bores 12 and 32 in preparation for blow-down of the bores. At step 226, compressed air is pumped down the substantially vertical well bores 12 and 32 to provide blow-down. The compressed air expands in the cavities 20 and 34, suspends the collected fluids within its volume and lifts the fluid to the surface. At the surface, air and produced methane or other gases are separated from the water and flared. The water may be disposed of as runoff, reinjected or moved to a remote site for disposal. In addition to providing gas lift, the blow-down may clean the cavities 20 and 34 and the vertical well bores 12 and 34 of debris and kick-off the well to initiate self-sustaining flow. In a particular embodiment, the blow-down may last for one, two or a few weeks.

At step 228, production equipment is installed in the substantially vertical well bores 12 and 34 in place of the gas lift equipment. The production equipment may include a well head and a sucker rod pump extending down into the cavities 20 and 34 for removing water from the coal seam 15. If a well is shut in for any period of time, water builds up in the cavity 20 or 34 or self-sustaining flow is otherwise terminated, the pump may be used to remove water and drop the pressure in the coal seam 15 to allow methane gas to continue to be diffused and to be produced up the annulus of the substantially vertical well bore.

At step 230, methane gas diffused from the coal seam 15 is continuously produced at the surface 14. Methane gas may be produced in two-phase flow with the water or otherwise produced with water and/or produced after reservoir pressure has been suitably reduced. Proceeding to step 232, water that drains through the drainage patterns into the cavities that is not lifted by the produced gas is pumped to the surface with the rod pumping unit. Water may be continuously or intermittently pumped as needed for removal from the cavities 20 and 34.

Next, at decisional step 234 it is determined whether the production of gas from the coal seam 15 is complete. In a particular embodiment, approximately seventy-five percent of the total gas in the coverage area of the coal seam may be produced at the completion of gas production. The production of gas may be complete after the cost of the collecting the gas exceeds the revenue generated by the well. Alternatively, gas may continue to be produced from the well until a remaining level of gas in the coal seam 15 is below required levels for mining or other operations. If production of the gas is not complete, the No branch of decisional step 234 returns to steps 230 and 232 in which gas and/or water continue to be removed from the coal seam 15. Upon completion of production, the Yes branch of decisional step 234 leads to the end of the process by which gas is produced from a coal seam. It will be understood that one or more steps may be modified, omitted, or performed in a different order. Additional steps may be added.

Figure 7:
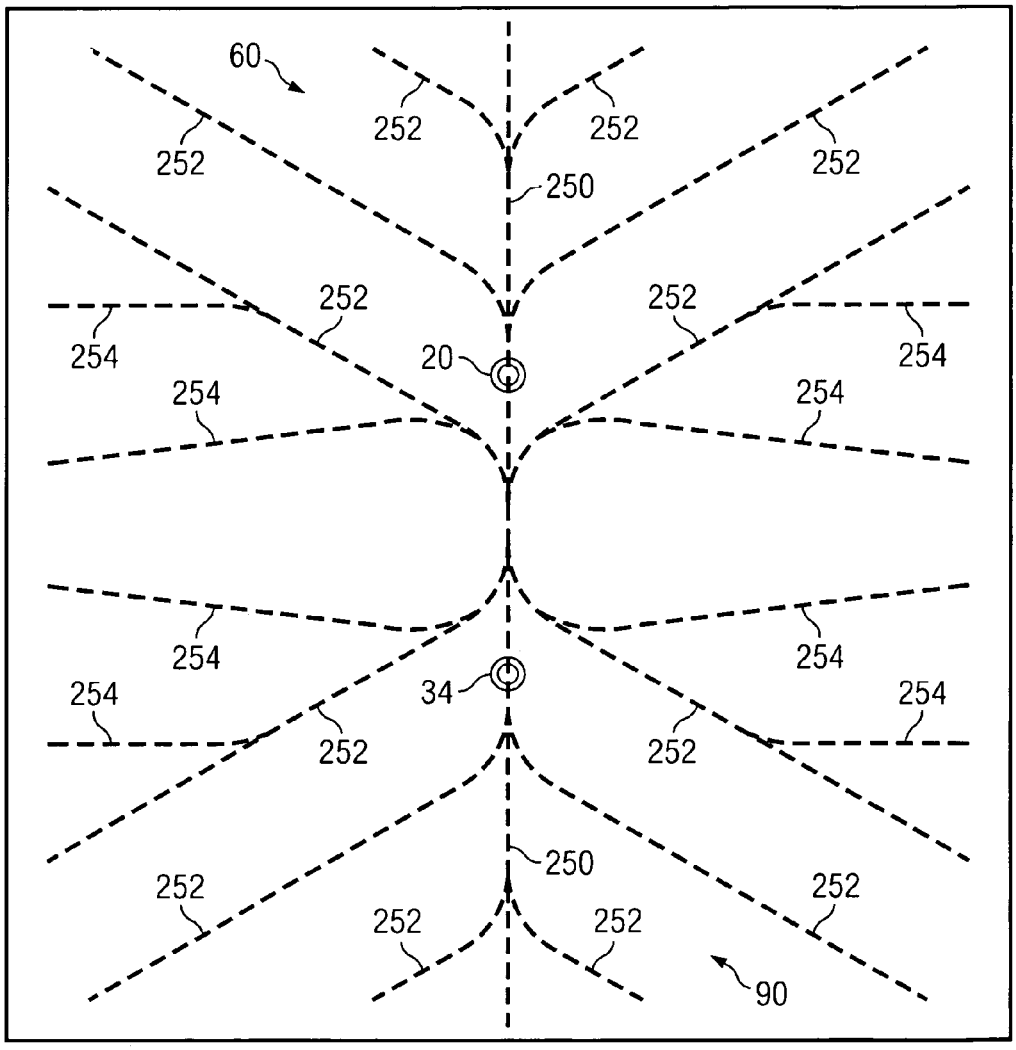
FIG. 7 illustrates another embodiment of the subterranean patterns of the well system of FIG. 3.

FIG. 7 illustrates another embodiment of the subterranean patterns 60 and 90 for accessing the coal seam 15 or other subterranean zone. As previously discussed the subterranean patterns 60 and 90 may each comprise a multi-lateral pattern that has a main bore with generally symmetrically arranged and appropriately spaced laterals extending from each side of the main bore. In the embodiment of FIG. 7, the patterns 60 and 90 are each formed with laterals extending from the main bore before and after interception of the corresponding cavity 20 or 34.

Referring to FIG. 7, patterns 60 and 90 may each include a main bore 250 extending through a corresponding cavity 20 or 34, or intersecting well bore 12 or 32, along a center of a coverage area. The main bore 250 includes one or more primary lateral bores 252 extending from the main bore 250 to or at least approximately to the periphery of the coverage area. The primary lateral bores 252 may extend from opposite sides of the main bore 250. One or more secondary lateral bores 254 may be formed off one or more of the primary lateral bores 252. In a particular embodiment, a set of secondary lateral bores 254 may be formed off the first primary lateral bore 252 of each pattern 60 and 90.

The patterns 60 and 90 may be formed with the cavities 20 and 34 between laterals 252 to achieve a desired spacing. For example, the wells 12 and 32, and thus cavities 20 and 34, may be vertical and offset a minimum well statutory spacing by forming laterals 252 and 254 between the cavities 20 and 34. As a result, in one embodiment, for example, spacing requirements may be met and/or special exemptions or permission requests avoided while still providing access to the coverage area.

Although the present invention has been described with several embodiments, various changes and modifications may be suggested to one skilled in the art. It is intended that the present invention encompass such changes and modifications as fall within the scope of the appended claims and their equivalence.

What is claimed is:

1. A well system, comprising;

a first well bore extending from a surface to a subterranean zone;

a second well bore extending from the surface to the subterranean zone;

a first articulated well bore formed off of the first well bore, the first articulated well bore intersecting and extending through the second well bore and coupled to a first pattern formed in the subterranean zone through the first articulated well bore;

a second articulated well bore formed off of the second well bore, the second articulated well bore intersecting and extending through the first well bore and coupled to a second pattern formed in the subterranean zone through the second articulated well bore;

the first pattern operable to transport fluids from the subterranean zone to the second well for production to the surface; and the second pattern operable to transport fluids from the subterranean zone to the first well for production to the surface.

2. The well system of claim 1, wherein the first and second patterns each comprise a main substantially horizontal well bore.

3. The well system of claim 1, wherein the first and second patterns each comprise a main substantially horizontal well bore and a plurality of lateral well bores extending from the main substantially horizontal well bore.

4. The well system of claim 1, wherein the first and second patterns each comprise a substantially horizontal pinnate pattern.

5. The well system of claim 3, wherein, for each pattern, the distance from a distal end of each lateral well bore to the intersecting well bore through the lateral well bore and the main substantially horizontal well bore are substantially equal.

6. The well system of claim 1, further comprising:

a first cavity coupled to the first well bore and operable to collect fluids transported by the second pattern for production to the surface; and a second cavity coupled to the second well the second cavity operable to collect fluids transported by the first pattern for production to the surface.

7. The well system of claim 1, wherein the subterranean zone comprises a coal seam.

8. The well system of claim 7, when the fluids comprise water and coal bed methane (CBM) gas.

9. The well system of claim 1, further comprising:

the first articulated well bore including a packer disposed between the first well bore and intersection of the second well bore;

the second articulated well bore including a packer disposed between the second well bore and intersection of the first well bore.

10. The well system of claim 1, wherein the first and second pattern together comprise a coverage area in the subterranean zone of at least 600 acres.

11. The well system of claim 3, wherein a lateral of the first pattern extends from the main substantially horizontal well bore prior to intersection with the second well bore and a lateral of the second pattern extends from the main substantially horizontal well bore prior to intersection with the first well bore.

12. A well system, comprising:

at least two well bores extending from a surface to a subterranean zone;

each of the two well bores being used to form a substantially horizontal well bore pattern for the subterranean zone that intersects the other well bore and extends beyond the other well bore and transports fluid from the subterranean zone to the other well bore for production to the surface; and each of the two well bores operable to collect for production to the surface fluids transported to the well bore by the substantially horizontal well bore pattern formed through the other well bore.

13. The well system of claim 12 wherein the substantially horizontal well bore patterns each comprise a main well bore and a plurality of lateral well bores extending from the main well bore.

14. The well system of claim 12, wherein the substantially horizontal well bore patterns each comprise a pinnate pattern.

15. The well system of claim 13, wherein, for each pattern, the distance from a distal end of each lateral to the intersecting well bore through the lateral well bore and the main well bore are substantially equal.

16. The well system of claim 12, further comprising each of the two well bores including a cavity in the subterranean zone to collect fluids transported by a connected well bore pattern.

17. The well system of claim 12, wherein the subterranean zone comprises a coal seam.

18. A method for forming a well system, comprising:

forming a first well bore extending from a surface to a subterranean zone;

forming a second well bore extending from the surface to the subterranean zone;

kicking off the first well bore above the subterranean zone to form a first subterranean pattern in the subterranean zone, the first subterranean pattern coupled to the second well bore and operable to transport fluids from the subterranean zone to the second well bore for production to the surface through the second well bore; and kicking off the second well bore above the subterranean formation to form a second subterranean pattern in the subterranean formation, the second subterranean pattern coupled to the first well bore, located on an opposite side of the first well bore from the first subterranean pattern, and operable to transport fluids from the subterranean zone to the first well bore for production to the surface through the first well bore.

19. The method of claim 18, wherein at least one of the first and second subterranean patterns are formed by drilling in an under-balanced state.

20. The method of claim 18, further comprising:

forming a first cavity in the first well bore proximate to the subterranean zone;

forming a second cavity in the second well bore proximate to the subterranean zone; and wherein the first subterranean pattern intersects the cavity of the second well bore and the second subterranean pattern intersects the cavity of the first well bore.

21. A method for forming a well system, comprising:

forming a first well bore having a cavity proximate to a subterranean zone;

forming a second well bore having a cavity proximate to the subterranean zone;

kicking off the first well bore above the subterranean zone to form a first pattern in the subterranean zone, the first pattern intersecting the cavity of the second well bore and operable to transport fluids from the subterranean zone to the cavity of the second well bore for production to the surface through the second well bore; and kicking off the second well bore above the subterranean formation to form a second pattern in the subterranean formation, the second pattern intersecting the cavity of the first well bore and operable to transport fluids from the subterranean zone to the first well bore for production to the surface through the first well bore.

22. The method of claim 21, further comprising initiating production in the first and second well bores by gas lift.

* * * * *